US008259987B2

(12) United States Patent
Omoda

(10) Patent No.: US 8,259,987 B2
(45) Date of Patent: Sep. 4, 2012

(54) DIAPHRAGM, DIAPHRAGM ASSEMBLY AND ELECTROACOUSTIC TRANSDUCER

(75) Inventor: Manabu Omoda, Yokohama (JP)

(73) Assignee: Victor Company of Japan, Ltd., Kanagawa-Ken (JP)

( * ) Notice: Subject to any disclaimer, the term of this patent is extended or adjusted under 35 U.S.C. 154(b) by 1093 days.

(21) Appl. No.: 12/008,126

(22) Filed: Jan. 9, 2008

(65) Prior Publication Data

US 2008/0212808 A1 Sep. 4, 2008

(30) Foreign Application Priority Data

Jan. 11, 2007 (JP) ..... 2007-3163
Jan. 11, 2007 (JP) ..... 2007-3164
Jan. 11, 2007 (JP) ..... 2007-3165

(51) Int. Cl.
*H04R 1/00* (2006.01)
*H04R 1/02* (2006.01)
*H04R 7/00* (2006.01)
*H04R 25/00* (2006.01)

(52) U.S. Cl. ..... 381/423; 381/191; 381/392; 381/396; 381/400; 381/407; 381/409; 381/412; 381/424; 381/426; 381/430; 381/431; 181/171; 181/172; 181/173; D14/214; D14/258

(58) Field of Classification Search ..... 381/423, 381/396, 407, 430; 181/173
See application file for complete search history.

(56) References Cited

U.S. PATENT DOCUMENTS 4,354,066 A * 10/1982 Necoechea ..... 381/408
4,881,617 A * 11/1989 Faraone ..... 181/164
5,371,805 A * 12/1994 Saiki et al. ..... 381/398
5,664,024 A * 9/1997 Furuta et al. ..... 381/412
6,201,874 B1 * 3/2001 Croft et al. ..... 381/191
6,341,167 B1 * 1/2002 Okuyama et al. ..... 381/407
6,474,440 B2 * 11/2002 Kato ..... 181/161
6,594,372 B2 * 7/2003 Nakaso ..... 381/396
6,654,475 B2 * 11/2003 Nakaso ..... 381/396

(Continued)

FOREIGN PATENT DOCUMENTS

JP 02-087488 3/1990

(Continued)

*Primary Examiner* — David Warren
*Assistant Examiner* — Christina Russell
(74) *Attorney, Agent, or Firm* — Renner, Kenner, Greive, Bobak, Taylor & Weber

(57) ABSTRACT

A slender-type diaphragm longer in a longitudinal direction and shorter in a transversal direction in relation to the longitudinal direction, has a base member and a slant member. The base member has a pair of extending members provided in parallel in the longitudinal direction as facing each other, and a curved section that protrudes toward a first side of the diaphragm in a vibration direction of the diaphragm from a first plane that includes the extending members, the vibration direction being perpendicular to the longitudinal and transversal directions. The slant member has a slant surface in relation to the first plane and connected to the base member in a manner that the slant member surrounds the base member in a second plane parallel to the first plane, the slant member having a curved surface in a cross section thereof in relation to a cross section of the base member in the transversal direction.

10 Claims, 17 Drawing Sheets

U.S. PATENT DOCUMENTS

| | | | | |
|---|---|---|---|---|
| 6,920,957 | B2 * | 7/2005 | Usuki et al. | 181/173 |
| 7,200,241 | B2 * | 4/2007 | Fukuyama et al. | 381/407 |
| 7,221,773 | B2 * | 5/2007 | Takahashi | 381/430 |
| D573,583 | S * | 7/2008 | Omoda | D14/214 |
| 7,416,047 | B2 * | 8/2008 | Frasl et al. | 181/173 |
| 7,483,545 | B2 * | 1/2009 | Nagaoka | 381/423 |
| 7,510,047 | B2 * | 3/2009 | Muto et al. | 181/173 |
| 7,801,324 | B2 * | 9/2010 | Kimura et al. | 381/430 |
| 7,864,977 | B2 * | 1/2011 | Sadaie et al. | 381/407 |
| 7,873,179 | B2 * | 1/2011 | Takewa | 381/401 |
| 2003/0021435 | A1 * | 1/2003 | Nakaso | 381/396 |
| 2005/0041830 | A1 * | 2/2005 | Takewa et al. | 381/410 |
| 2009/0139794 | A1 * | 6/2009 | Silver | 181/171 |
| 2011/0026757 | A1 * | 2/2011 | Takahashi et al. | 381/397 |

FOREIGN PATENT DOCUMENTS

| | | | |
|---|---|---|---|
| JP | 2001-268688 | | 9/2001 |
| JP | 2002-218589 | | 8/2002 |
| JP | 2002271887 | A * | 9/2002 |
| JP | 2002-325294 | | 11/2002 |
| JP | 2004-128822 | | 4/2004 |
| JP | 2004-297315 | | 10/2004 |
| JP | 2005-159804 | | 6/2005 |
| JP | 2005-260537 | | 9/2005 |
| JP | 2006-287418 | | 10/2006 |
| JP | 2006-340210 | | 12/2006 |

* cited by examiner

DIAPHRAGM, DIAPHRAGM ASSEMBLY AND ELECTROACOUSTIC TRANSDUCER

CROSS-REFERENCE TO RELATED APPLICATIONS

This application is based on and claims the benefit of priority from the prior Japanese Patent Application Nos. 2007-003163, 2007-003164, and 2007-003165 each filed on Jan. 11, 2007, the entire contents of which is incorporated herein by reference.

BACKGROUND OF THE INVENTION

The present invention relates to an electroacoustic transducer, especially to an electroacoustic transducer having a slender diaphragm.

Much attention has been given to slender-type electroacoustic transducers that exhibit high space saveability and excellent audio characteristics, for use in TVs, speakers in surround systems.

The applicant of the present invention has proposed such a slender-type electroacoustic transducer, which will also be referred to as an SPU (Speaker Unit) hereinafter, in documents, for example, Japanese Unexamined Patent Publications Nos. 2002-325294 and 2004-297315 (referred to as Document 1 and 2, respectively, hereinafter).

Document 1 discloses an electroacoustic transducer equipped with a track-like diaphragm supported by a rectangular frame via an edge member formed around the diaphragm and attached to the frame. As shown in FIGS. 1 and 4, the edge member is formed into a flat ring shape and attached to the frame at its outer periphery. In another word, the frame is the outermost member of the electroacoustic transducer in the transversal (width) direction.

In the description below, the structure of a diaphragm with an edge member formed therearound is referred to as a diaphragm assembly.

The market demands for slender speaker units with wider frequency characteristics. In order to meet the demand, the applicant proposes a "slim-type" electroacoustic transducer in Document 2. As shown in FIGS. 1 and 2, the slim type has a flange folded at its side section lying along the longitudinal section of the edge member and fixed to the outer surface of a frame. In another word, the edge member (flange) is the outermost member of the electroacoustic transducer in the transversal direction within a zone including at least a diaphragm.

Compared to the electroacoustic transducer in Document 1, the slim type is much narrower in the transversal direction with its flange folded at the side section and fixed to the frame even though the diaphragm of the slim type is formed as having the same width as that in Document 1. For example, when the width of the electroacoustic transducer in Document 1 is 30 mm, the slim type in Document 2 can be formed as having the width of 22 mm even though the diaphragm has the same width in both transducers.

In another word, the slim type can be formed as having the same width for the diaphragm as that of Document 1 even though the width of the transducer is made narrower than that of Document 1. The slim type thus maintains comparatively wide linear response range for the diaphragm to a driving force applied thereto.

The electroacoustic transducers in Document 1 and 2 are both produced such that the yoke and the frame are boned to each other at their side sections at the longitudinal (length) direction, and almost sealed except for the end sections of the diaphragm in the rear side in the transversal (width) direction.

In spite of the advantages of the slim-type electroacoustic transducer discussed above, the inventor of the present invention found several disadvantages listed below, when trying to achieve wider frequency range in reproduction of low sounds and higher efficiency, and also to improve input characteristics to larger inputs, with a wider diaphragm.

(1) A wider diaphragm causes a low ridigity to the diaphragm assembly of the diaphragm with the edge member, resulting in poor frequency characteristics.

(2) A wider diaphragm causes that the diaphragm supporting and driving mechanisms become weaker physically to the wider diaphragm, resulting in unstable vibration of the diaphragm at larger strokes.

(3) A wider diaphragm causes excess heat from the voice coil when a large drive current is applied, resulting in a break in the coil windings, thermal degradation of the adhesive or the peripheral members of the voice coil, etc., with shorter life and poor aging reliability.

(4) A wider diaphragm causes an excess pressure to the rear side of the diaphragm when it vibrates at a large stroke because the diaphragm is almost sealed except for the end sections of the diaphragm in the rear side in the transversal direction, resulting in aerodynamic noises easily generated from the gap formed in the diaphragm assembly.

(5) A wider diaphragm causes a larger swing to a pair of lead wires of the diaphragm when it vibrates at a larger stroke, which further causes that lead wires touch each other so that it may cause a short between the wires, resulting in lower reliability.

Besides the problems of the wider diaphragm discussed above, the slim-type electroacoustic transducer has another problem. A problem could occur when this type of transducers are piled each other, for shipment, with the diaphragm assembly of the diaphragm and the edge member attached to the diaphragm. In detail, the members that vibrate when driven, such as, the diaphragm and the rolled section of the edge member, could touch each other when the transducers are piled and thus could be damaged or deformed.

SUMMARY OF THE INVENTION

A purpose of the present invention is to provide a diaphragm, a diaphragm assembly and an electroacoustic transducer that exhibit excellent aging characteristics and higher reliability, with less aerodynamic noises in the rear side.

The present invention provides a diaphragm longer in a longitudinal direction and shorter in a transversal direction in relation to the longitudinal direction, comprising: a base member having a pair of extending members provided in parallel in the longitudinal direction as facing each other, and a curved section that protrudes toward a first side of the diaphragm in a vibration direction of the diaphragm from a first plane that includes the extending members, the vibration direction being perpendicular to the longitudinal and transversal directions; and a slant member having a slant surface in relation to the first plane and connected to the base member in a manner that the slant member surrounds the base member in a second plane parallel to the first plane, the slant member having a curved surface in a cross section thereof in relation to a cross section of the base member in the transversal direction.

Moreover, the present invention provides a diaphragm assembly comprising: a diaphragm having a first length in a longitudinal direction and a second length in a transversal direction in relation to the longitudinal direction, the first length being longer than the second length, the diaphragm including: a base member having a pair of extending members provided in parallel in the longitudinal direction as facing each other, and a curved section that protrudes toward a first side of the diaphragm in a vibration direction of the diaphragm from a first plane that includes the extending members, the vibration direction being perpendicular to the longitudinal and transversal directions, and a slant member having a slant surface in relation to the first plane and connected to the base member in a manner that the slant member surrounds the base member in a second plane parallel to the first plane, the slant member having a curved surface in a cross section thereof in relation to a cross section of the base member in the transversal direction, the diaphragm assembly further comprising: an edge member having a third length in the longitudinal direction and a fourth length in the transversal direction, the third length being longer than the first and fourth lengths, the fourth length being longer than the second length, the diaphragm being supported by the edge member in a manner that the edge member surrounds the diaphragm in a third plane parallel to the first plane, the edge member having a flange extending in a second side of the diaphragm, the second side being opposite of the first side in the vibrating direction.

Furthermore, the present invention provides an electroacoustic transducer comprising: a diaphragm assembly including: a diaphragm having a first length in a longitudinal direction and a second length in a transversal direction in relation to the longitudinal direction, the first length being longer than the second length, the diaphragm including a base member having a pair of extending members provided in parallel in the longitudinal direction as facing each other, and a curved section that protrudes toward a first side of the diaphragm in a vibrating direction of the diaphragm from a first plane that includes the extending members, the vibrating direction being perpendicular to the longitudinal and transversal directions, and the diaphragm including a slant member having a slant surface in relation to the first plane and connected to the base member in a manner that the slant member surrounds the base member in a second plane parallel to the first plane, the slant member having a curved surface in a cross section thereof in relation to a cross section of the base member in the transversal direction; and an edge member having a third length in the longitudinal direction and a fourth length in the transversal direction, the third length being longer than the first and fourth lengths, the fourth length being longer than the second length, the diaphragm being supported by the edge member in a manner that the edge member surrounds the diaphragm in a third plane parallel to the first plane, the edge member having a flange extending in a second side of the diaphragm, the second side being opposite of the first side in the vibration direction, the electroacoustic transducer further comprising: a frame having a pair of first frame members in the longitudinal direction and a pair of second frame members in the transversal direction, the first frame members being longer than the second frame members, the first frame members being fixed to the flange, the frame being fixed to the edge member in a manner that the diaphragm assembly is surrounded by the frame in a fourth plane parallel to the first plane, and can vibrate in the vibrating direction in the frame.

Furthermore, the present invention provides an electroacoustic transducer comprising: a slender-shape diaphragm longer in a longitudinal direction and shorter in a transversal direction in relation to the longitudinal direction; an edge member fixed to the diaphragm; a frame having a pair of first frame members in the longitudinal direction and a pair of second frame members in the transversal direction, the first frame members being longer than the second frame members, the edge member being fixed to each frame member, the frame supporting the diaphragm via the edge member in a manner that the diaphragm can vibrate freely in a vibration direction perpendicular to the longitudinal and transversal directions; a voice-coil bobbin having a shape corresponding to the shape of the diaphragm and fixed in a first side of the diaphragm in the vibration direction, the voice-coil bobbin having a voice coil wound therearound; at least one magnet provided inside the voice-coil bobbin; and a yoke having a base member and side wall sections extending in the first side of the diaphragm in the transversal direction, thus having an opening in a second side of the diaphragm, the second side being opposite of the first side in the vibrating direction, the magnet being placed on the base member through the opening and supported by the base member, wherein each first frame member has a rib protruding toward the first side of the diaphragm, the yoke being fixed to the frame at both ends of the yoke in the transversal direction, with a gap between each side wall section and the rib.

Still, furthermore, the present invention provides an electroacoustic transducer comprising: a slender-shape diaphragm longer in a longitudinal direction and shorter in a transversal direction in relation to the longitudinal direction; an edge member fixed to the diaphragm; a frame having a pair of first frame members in the longitudinal direction and a pair of second frame members in the transversal direction, the first frame members being longer than the second frame members, the edge member being fixed to each frame member, the frame supporting the diaphragm via the edge member in a manner that the diaphragm can vibrate freely in a vibration direction perpendicular to the longitudinal and transversal directions; a voice-coil bobbin having a shape corresponding to the shape of the diaphragm and fixed in a first side of the diaphragm in the vibration direction, a voice coil wound around the voice-coil bobbin, a pair of lead wires being connected to the voice coil through the voice-coil bobbin; at least one magnet provided inside the voice-coil bobbin; and a yoke for supporting the magnet, the yoke having an insulating wall that protrudes toward a second side of the diaphragm, the second side being opposite of the first side in the vibration direction, the insulating wall being located between the lead wires outside the voice-coil bobbin.

DETAILED DESCRIPTION OF PREFERRED EMBODIMENTS

Figure 1:
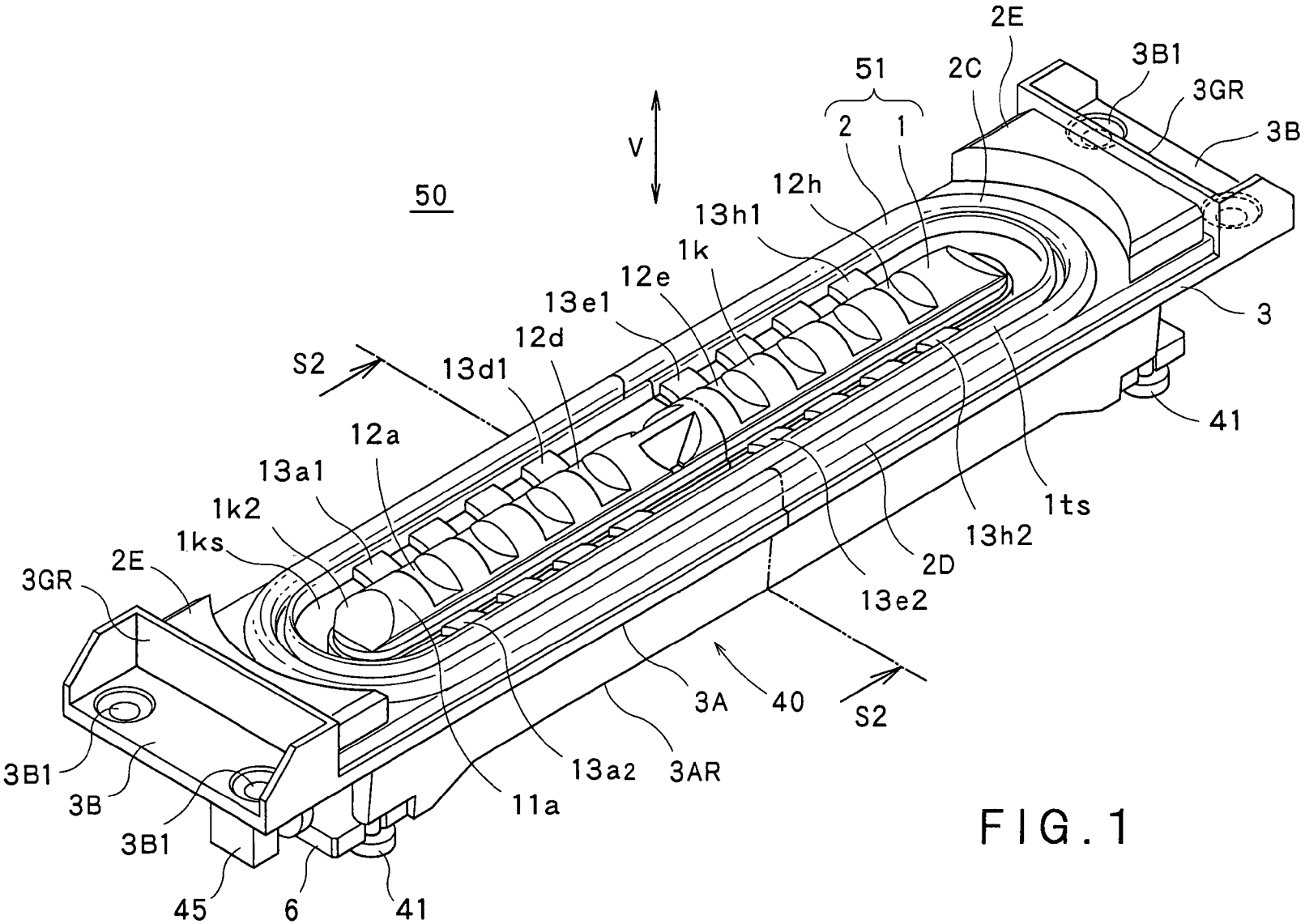
FIG. 1 shows a front perspective view illustrating an embodiment of an electroacoustic transducer according to the present invention.

A preferred embodiment according to the present invention, an SPU 50 that is an electroacoustic transducer, will be disclosed with reference to FIGS. 1 to 17.

The SPU 50 includes a diaphragm 1, an edge member 2, a frame 3, and a drive mechanism 40 that has a main magnet 7M, a sub-magnet 7S, a yoke 6, etc.

Figure 4:
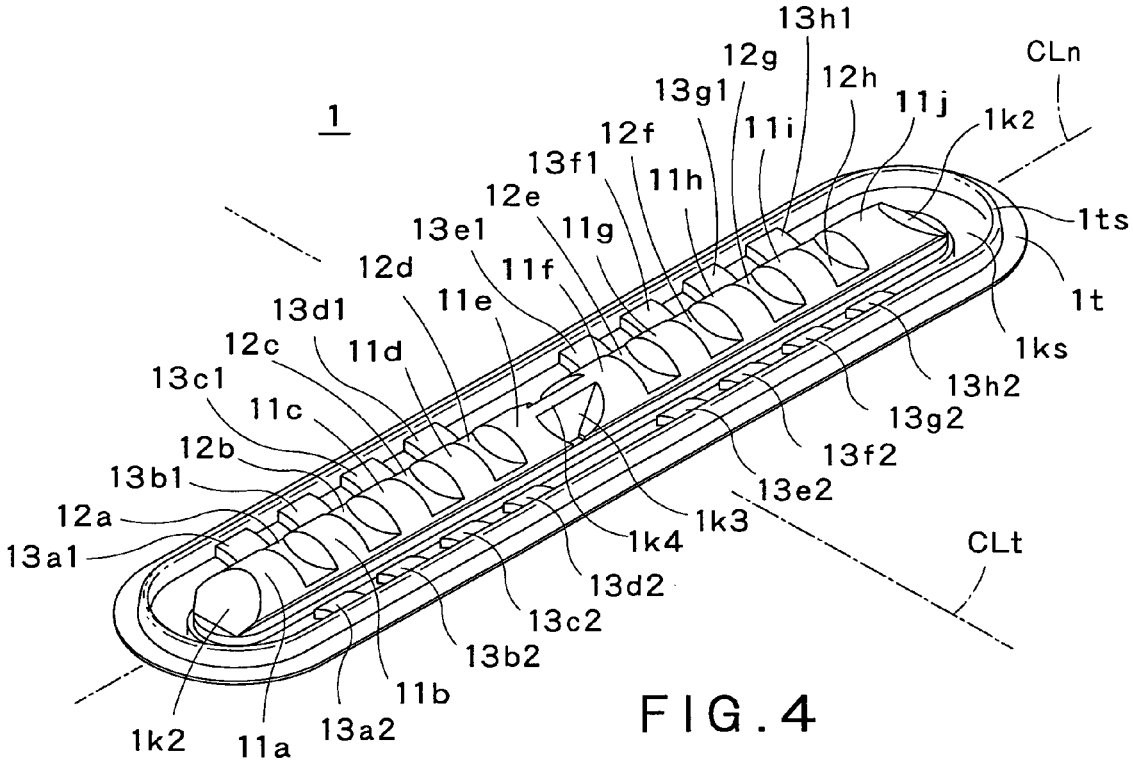
FIG. 4 shows a perspective view illustrating a diaphragm in the embodiment of the electroacoustic transducer according to the present invention.
Figure 5:
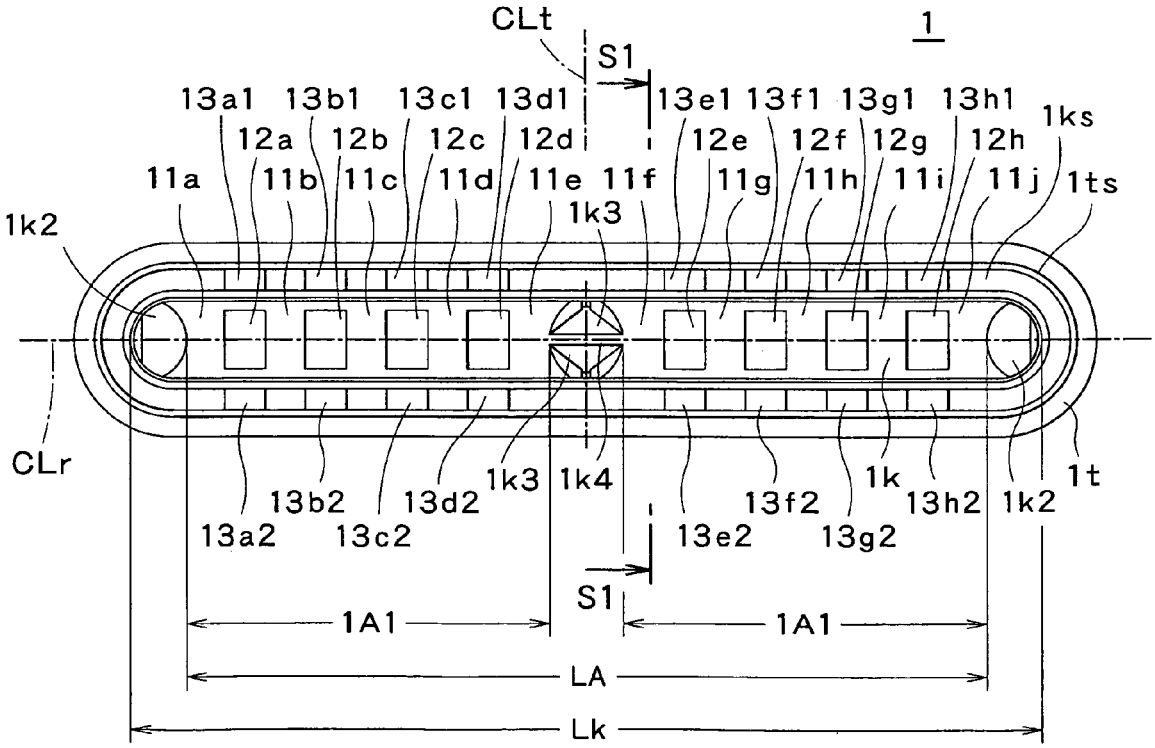
FIG. 5 shows a top view illustrating the diaphragm in the embodiment of the electroacoustic transducer according to the present invention.

As shown in FIGS. 4 and 5, the diaphragm 1 has a slender oval shape with long sides opposite each other and arc-like sections connected the long sides at both ends. The diaphragm 1 may have a rectangular shape with four round corners with no such arc-like sections.

Figure 10:
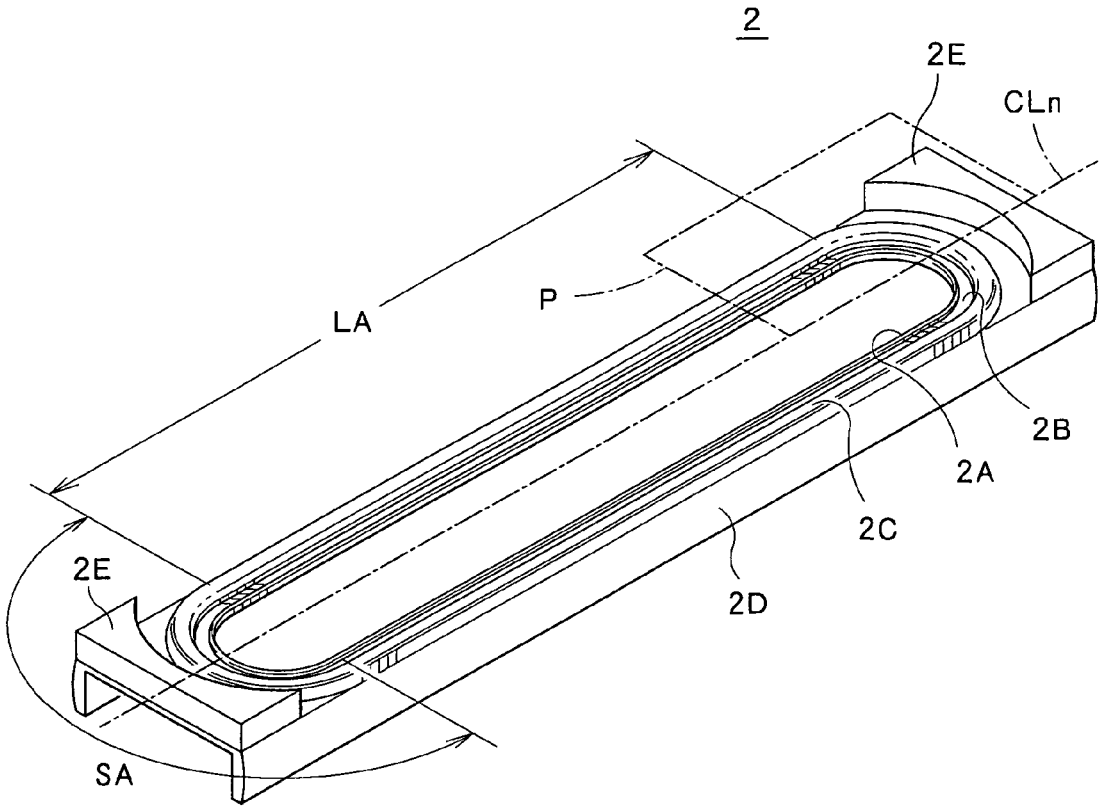
FIG. 10 shows a perspective view illustrating an edge member in the embodiment of the electroacoustic transducer according to the present invention.
Figure 11:
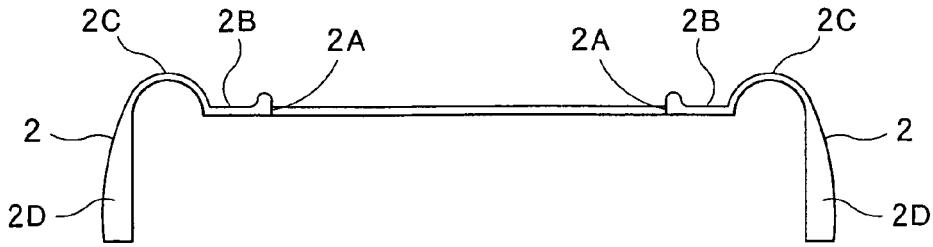
FIG. 11 shows a sectional view illustrating the edge member in the embodiment of the electroacoustic transducer according to the present invention.

The edge member 2 is attached to the diaphragm 1 at the outer periphery of the diaphragm 1, as shown in FIG. 1, to support the diaphragm 1 in such a manner that the diaphragm 1 can vibrate in a frame 3. The edge member 2 has an opening 2A that fits the diaphragm 1, as shown in FIG. 10. The edge member 2 is a frame-like member with an uneven section 2C, as shown in FIG. 11.

In the description below, the structure of the diaphragm 1 with the edge member 2 attached thereto is referred to as a diaphragm assembly 51.

Figure 13:
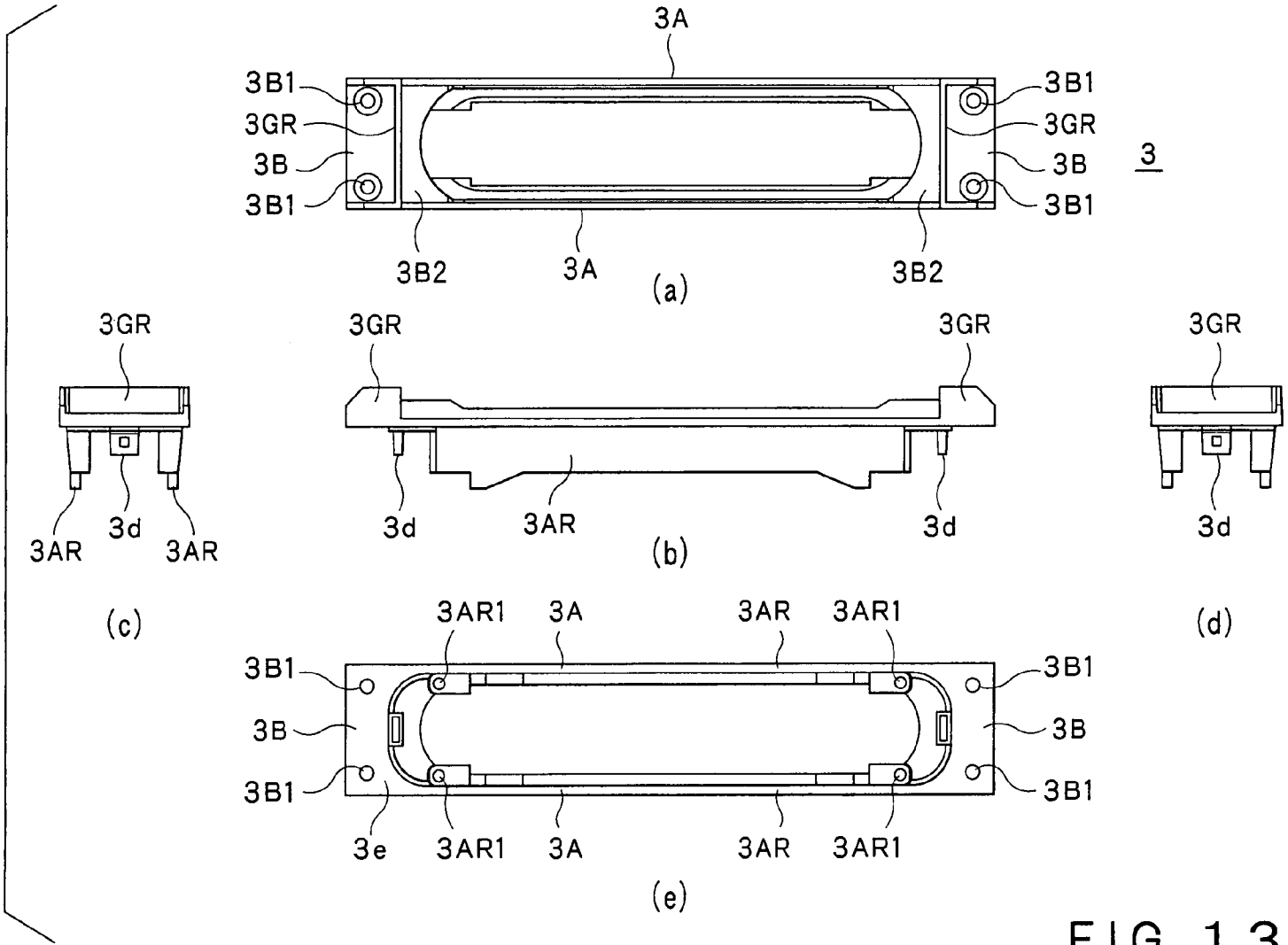
FIG. 13 shows a frame in the embodiment of the electroacoustic transducer according to the present invention, with a top view (a), a sectional view (b) in the longitudinal direction, side views (c) and (d) in the transversal direction, and a rear view (e)

As shown in FIG. 13, the frame 3 has a rectangular shape to support several members. In FIG. 1, the edge member 2 is fixed to the longer and shorter frame sections of the frame 3 at the outer periphery of the edge member 2 so that the edge member 2 is supported by the frame 3.

Figure 7:
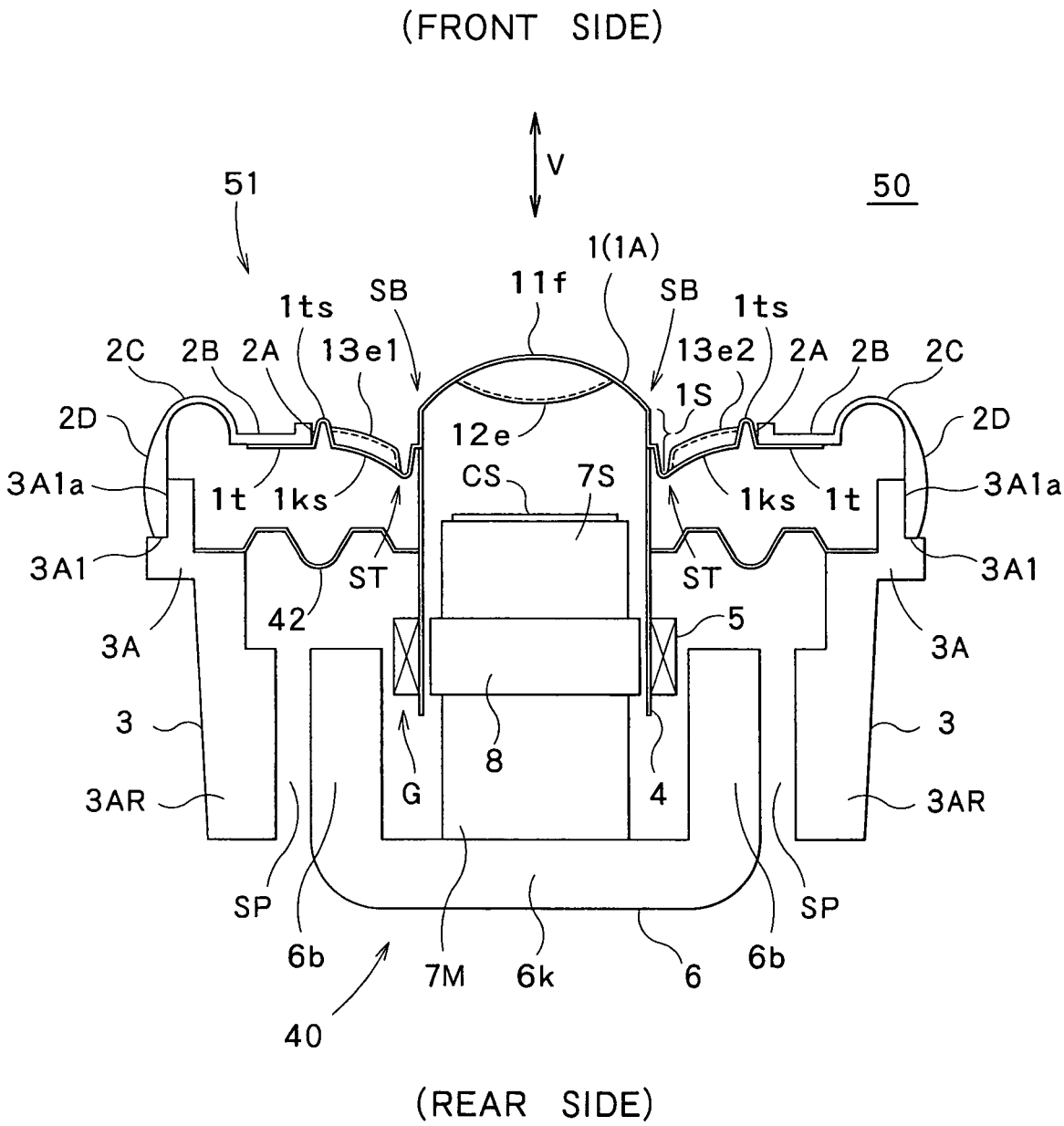
FIG. 7 shows a transverse sectional view illustrating the embodiment of the electroacoustic transducer according to the present invention.
Figure 14:
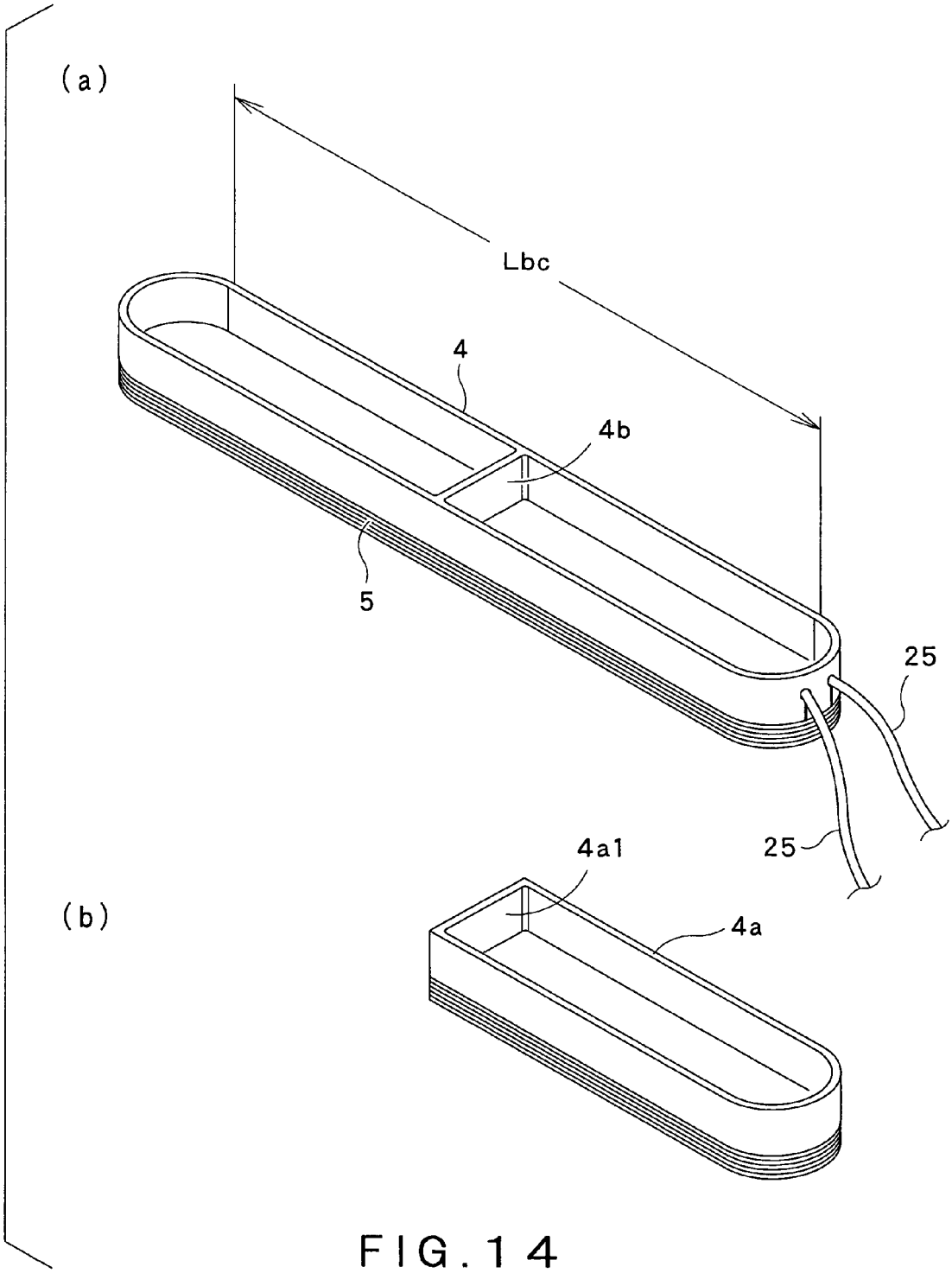
FIG. 14 show perspective views (a) and (b) illustrating a voice-coil bobbin in the embodiment of the electroacoustic transducer according to the present invention.

Attached to the diaphragm 1, as shown in FIG. 7 (a transverse sectional view taken on line S2-S2 in FIG. 1), is a voice-coil bobbin 4 having a slender oval shape like the diaphragm 1, as shown in FIG. 14, with a voice coil 5 wound therearound. The voice-coil bobbin 4 is hung in a magnetic gap G (FIG. 7) of a magnetic circuit which will be described later, to generate a driving power from audio signal currents and magnetic fluxes.

Figure 8:
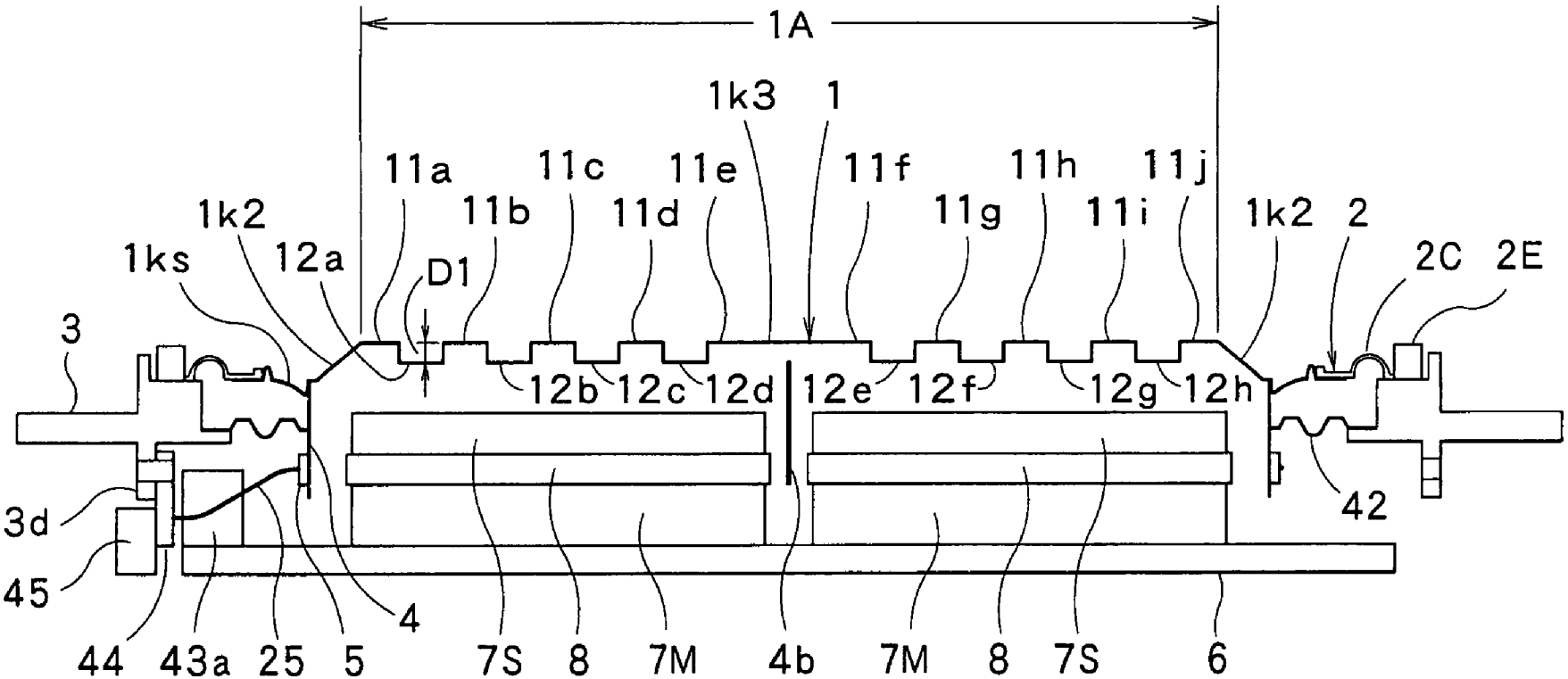
FIG. 8 shows a vertical perspective view illustrating the embodiment of the electroacoustic transducer according to the present invention.

Provided in the frame 3 is the drive mechanism 40, as shown in FIGS. 7 and 8, which is constituted by: the yoke 6 having a "π"-shape in cross section when viewed from the rear side, except for the both ends in the longitudinal direction, formed by press processing using an iron plate; the main magnet 7M fixed inside the "π"-shape yoke 6; a pole piece 8 provided on the magnet 7M so that it faces a main vibrating section 1A (located in a zone with concave and convex sections which will be described later in detail) of the diaphragm 1; and the sub-magnet 7S provided on the pole piece 8.

The sub-magnet 7S is covered with a cushion sheet CS made of, for example, nonwoven cloth, at its upper end, to protect the diaphragm 1 from being damaged. The damage could occur when the diaphragm 1 vibrates strongly in a direction V in response to excess input and then a concave section 12*e* formed in the main vibrating section 1A of the diaphragm 1 collides with the sub-magnet 7S violently and repeatedly.

Disclosed next in detail are the diaphragm 1, the edge member 2, the frame 3, and the drive mechanism 40.

(1) Diaphragm 1

Figure 6:
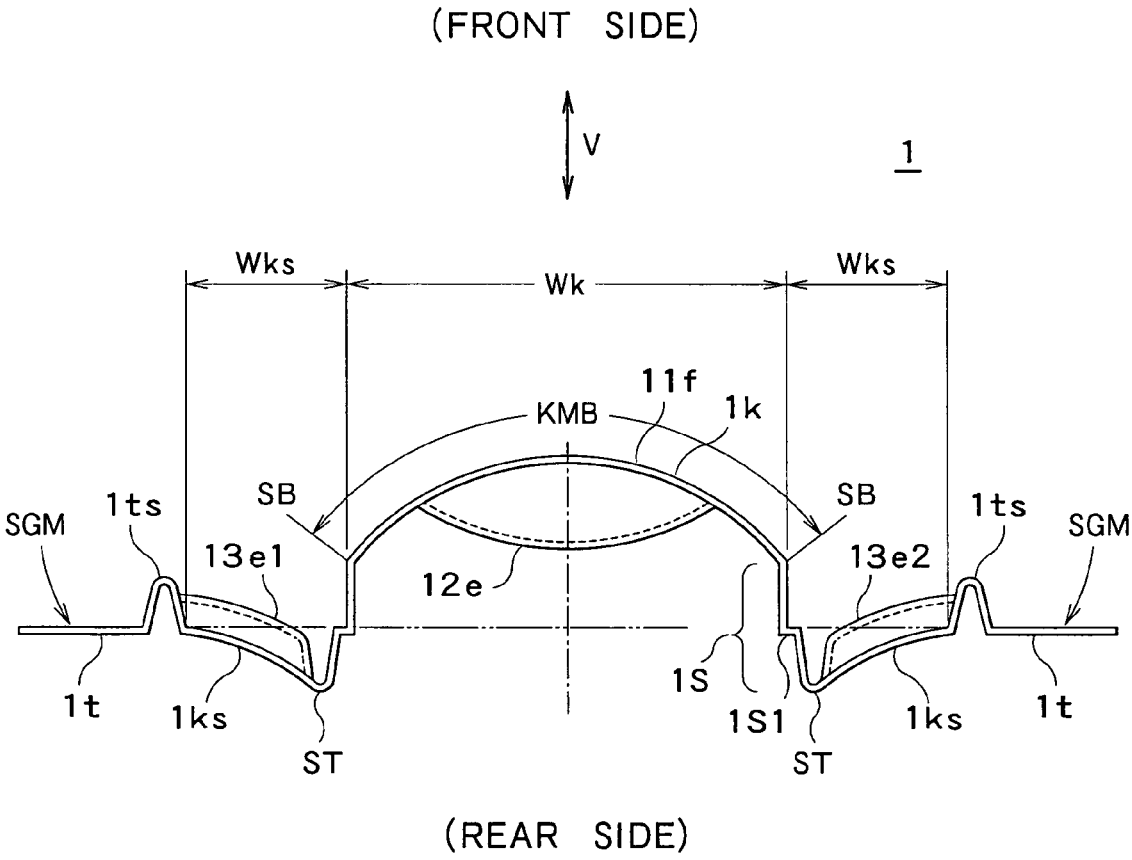
FIG. 6 shows a sectional view illustrating the diaphragm in the embodiment of the electroacoustic transducer according to the present invention.

The diaphragm 1 of the SPU 50 is disclosed in detail with reference to FIG. 4 (a perspective view from the front side), FIG. 5 (a top view from the front side), and FIG. 6 (a sectional view taken on line S1-S1 in FIG. 5).

The diaphragm 1 is illustrated with the front side and the rear side in the upper section and the lower section, respectively, in FIG. 6. The diaphragm 1 is driven to vibrate in the direction V. The direction V is referred to as a drive direction V or a vibration direction V, hereinafter.

As described above, the diaphragm 1 has a slender oval shape with the long sides opposite to each other and the arc-like sections connected the long sides at both ends. And, as shown in FIG. 6, the diaphragm 1 is formed as having: a base member 1*k* that has a curved portion protruding to the front side; side sections 1*s* (each having a step portion 1*s*1) that surround the base member 1*k* as the side sections 1*s* are connected to side portions SB of the base member 1*k* in the longitudinal direction and are lying in the vibration direction V; a slant member 1*ks* having a curved cross section, connected to the side sections 1*s* at bottom portions ST of the side sections 1*s* in the rear side; and a brim section 1*t* fixed to the slant member 1*ks* at side end portions of the slant member 1*ks* via a protrusion 1*ts* protruding toward the front side.

In FIG. 6, the base member 1*k* is illustrated as having an arc with a constant curvature in the transversal cross section. It may, however, be of any curve, such as, a parabola.

Moreover, in the top view in FIG. 5, the base member 1*k* has a similar shape in the outline as the diaphragm 1. It is surrounded by the slant member 1*ks*, the protrusion 1*ts*, and the brim section 1*t* in order.

Formed on the base member 1*k* are concave sections 12*a* to 12*d* and other concave sections 12*e* to 12*h* that are curved down in the vibration direction V in the rear side or protruding toward the rear side, as shown in FIG. 6 (in which the concave section 12*e* is only shown). The concave sections 12*a* to 12*d* and the other concave sections 12*e* to 12*h* are formed in line symmetry with respect to a transversal center line CLt (FIG. 5). The concave sections 12*a* to 12*h* are formed with the same depth D1, as shown in FIG. 8.

In relation to the concave sections 12*a* to 12*h*, there are convex sections 11*a* to 11*j* on the curved surface of the base member 1*k*, as shown in FIG. 4. The convex sections 11*a* to 11*j* and the concave sections 12*a* to 12*h* are formed alternately and continuously, with the same curvature. In this embodiment, the sections 11*a* to 11*j* are the curved surface of the base member 1*k* itself, or do not protrude from the curved surface. They are referred to as convex sections in relation to the concave sections 12*a* to 12*h*.

The longitudinal zone including the convex and concave sections 11*a* to 11*j* and 12*a* to 12*h*, respectively, is the main vibrating section 1A of the diaphragm 1 and faces the sub-magnet 7S, as shown in FIGS. 7 and 8.

The base member 1*k* is provided with flat slant members 1*k*2 at both ends in the longitudinal direction, as shown in FIGS. 4 to 8.

Provided in the center of the diaphragm 1 are slant members 1*k*3, as shown in FIG. 4, which are in line symmetry with respect to a longitudinal center line CLn and have slopes parallel to this line CLn. There is a ridge section 1*k*4 formed along the longitudinal center line CLn and between the slant members 1*k*3.

The slant members 1*ks* have a curved surface that sticks out toward the front side, with the center of curvature in the rear side, as shown in FIG. 6.

Formed on the slant member 1*ks* are convex sections 13*a*1 to 13*h*1 and other convex sections 13*a*2 to 13*h*2 so as to correspond to the concave sections 12*a* to 12*d* and 12*e* to 12*h*, respectively, as shown in FIG. 5. The convex sections 13*a*1 to 13*h*1 and 13*a*2 to 13*h*2 are formed with the same location and width as the concave sections 12*a* to 12*d* and 12*e* to 12*h* in the longitudinal direction.

In relation to the convex sections 13*a*1 to 13*h*1 and 13*a*2 to 13*h*2, the remaining portions of the slant member 1*ks* are referred to as concave sections, although the remaining portions are not curved toward the rear side. The concave and convex shape of the slant member 1*ks* is in the opposite phase with the concave and convex shape (the sections 12*a* to 12*h* and 11*a* to 11*j*) of the main vibrating section 1A of the diaphragm 1, as shown in FIG. 1.

The brim section 1*t* formed outside the protrusion 1*ts* is used for attaching the edge member 2 to the diaphragm 1 via the protrusion 1*ts* for positioning, as shown in FIG. 7, which will be discussed later in detail.

The diaphragm 1 is made of a polyimide (PI) film that is heat-resistant against heat generated from the voice coil 5 when energized and excellent in mechanical properties. The diaphragm 1 has a thickness of 0.125 mm, with chromium deposited on the surface thereof in the front side.

As shown in FIG. 7, provided at the rear side of the diaphragm 1 is the voice-coil bobbin 4 having the voice coil 5 wound therearound, the bobbin 4 being put in step portions 1*s*1 (FIG. 6) of the side sections 1*s*.

(2) Edge Member 2

The edge member 2 is a frame-like member with the opening 2A that fits the outer periphery of the protrusion 1*ts* (FIG. 1) of the diaphragm 1, as shown in FIG. 10 (a perspective view) and FIG. 11 (a sectional view at the center of the edge member 2 in the transversal direction.

The edge member 2 is provided with: a flat section 2B with the opening 2A inside thereof; a roll section 2C that protrudes like an oval so that it has an arc in the cross section; and flange sections 2D that are connected to the leg of the roll section 2C and extending to the opposite direction of the protruding direction of the roll section 2C.

Seat members 2E are provided at the outside of the roll section 2C and at both ends of the edge member 2 in the longitudinal direction. The seat members 2E protrude in the same direction as the roll section 2C, each with a flat surface having the same height as or higher than top of the diaphragm 1.

As shown in FIG. 10, the edge member 2 is formed like a "track" with a pair of longitudinal sections (longer areas LA) that face each other in the longitudinal direction and a pair of arc-like transversal sections (shorter areas SA) that connect the longitudinal sections at both ends. The term "track" means not only such a shape of the edge member 2 but also a rectangular shape with an arc at the four corners.

Figure 12:
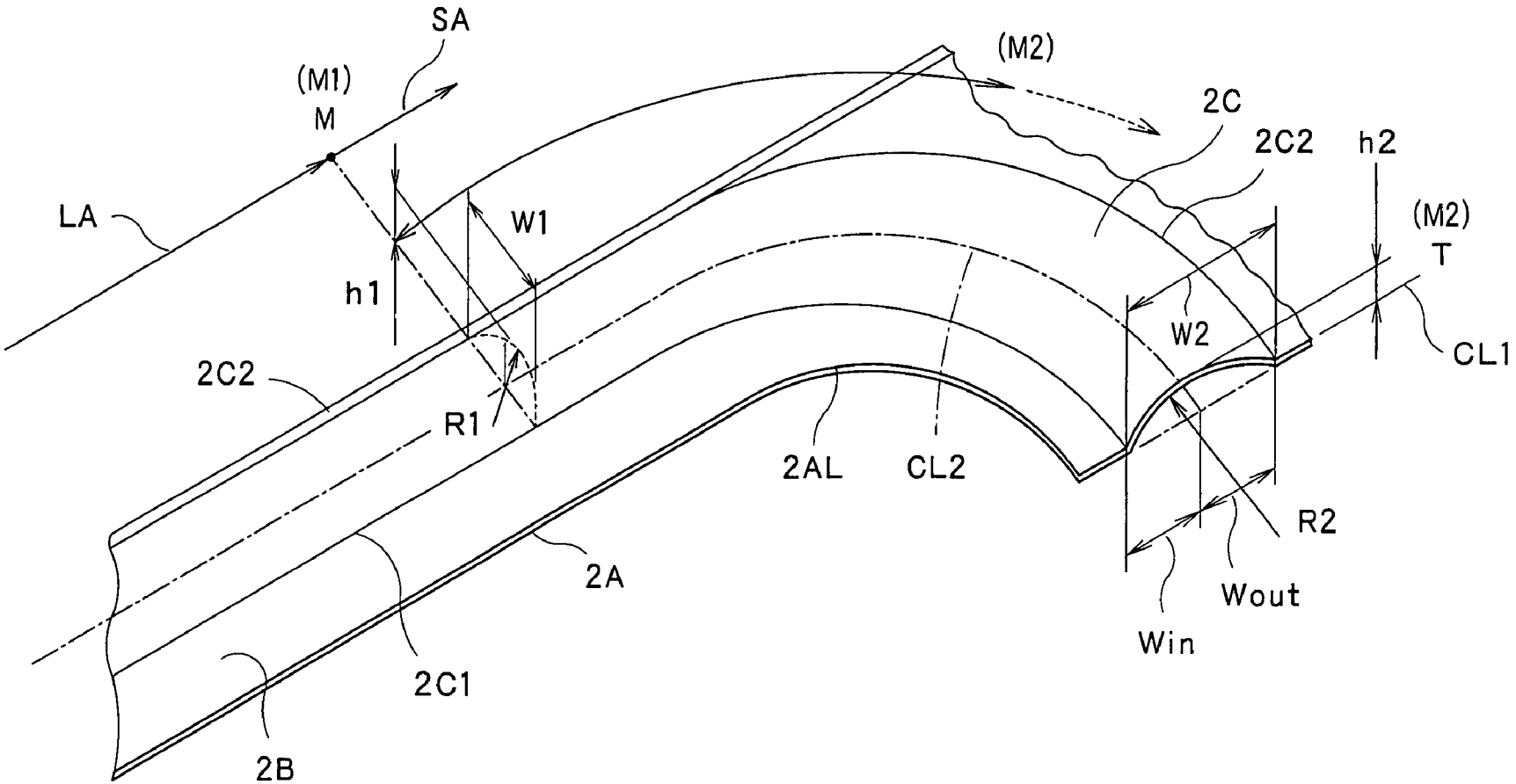
FIG. 12 shows a partial sectional view illustrating the edge member in the embodiment of the electroacoustic transducer according to the present invention.

The roll section 2C gradually curves at the cross section, or its arc portion, like shown in Document 2, which will be explained in detail with reference to FIG. 12. FIG. 12 shows an enlarged detail of one of four corners P depicted with a broken line in FIG. 10.

As shown in FIG. 12, the roll section 2C is formed as having a constant cross sectional shape with an outer curvature R1, a protruding height h1, and a roll width W1, in the longer areas LA.

The roll width W1 is a width of the roll section 2C from an inner border line 2C1 between the roll section 2C and the flat section 2B (the surface of the edge member 2) to an outer border line 2C2 between the roll section 2C and the flange section 2D (FIGS. 10 and 11).

In the shorter areas SA, the roll section 2C is formed as having the cross section for which the protruding height h1 and the roll width W1 are gradually increased from a transition starting point M1 toward a transition finishing point M2 which is a top T of the arc. The height h1 and width W1 reach the point M2 to be the maximum (a maximum outer curvature R2, a maximum protruding height h2, and a maximum roll width W2) at a center line CL1 that lies in the longitudinal direction of the edge member 2. The roll section 2C has the identical shape on both sides of the center line CL1. The ratio of increase in the outer curvature, the protruding height, and the width, or R2/R1, h2/h1 and W2/W1, is 1.2 in this embodiment.

The transition starting point M1 of the roll section 2C, for which the cross sectional shape starts to vary in the shorter areas SA, may be set at a point M where the longer and shorter areas LA and SA are connected to other or somewhere in the vicinity of the point M. The transition finishing point M2 of the roll section 2C, for which the cross section stops change in shape in the shorter areas SA, may not only be the top T of the arc but somewhere before reaching the top T. One requirement for the transition starting and finishing points M1 and M2 is that the points be gradually connected to the non-transitional areas, with no curves.

Moreover, as shown in FIG. 12, the roll section 2C is formed such that a distance Win and another distance Wout are equal to each other, although it gradually varies in its cross sectional shape in the shorter area SA, as discussed above. The distance Win is from the inner border line 2C1 to a center line CL2 of the roll section 2C. The center line CL2 has similarity to a line 2AL of the arc portion of the opening 2A. The distance Wout is from the outer border line 2C2 to the center line CL2.

The edge member 2 having such a rolling shape, as discussed above, can be made of butyl rubber or other materials of excellent characteristics on thermal tolerance, vibration, etc. The edge member 2 is formed with a thickness in the range from 0.2 mm to 0.3 mm except for the seat members 2E (FIG. 10).

The diaphragm assembly 51 of the diaphragm 1 with the edge member 2 is produced in such a manner that, as shown in FIG. 7, the diaphragm 1 is inserted into the opening 2A of the edge member 2 from the rear side so that the outer periphery of the protrusion its of the diaphragm 1 is engaged with the wall of the opening 2A. This engagement increases the contact area of the diaphragm 1 with the edge member 2 so that both can be firmly fixed to each other at the upper surface (the front side) of the brim section 1*t* of the diaphragm 1 and the lower surface (the rear side) of the flat section 2B of the edge member 2, bonded to each other with an adhesive.

(3) Frame 3

As shown in FIG. 13, the frame 3 is a rectangular-shape support member for supporting several members of the diaphragm assembly 51. The frame 3 consists of a pair of longitudinal frame members 3A and a pair of transversal frame members 3B, connected to each other, made by die casting with a non-magnetic material such as aluminum.

Each transversal frame member 3B is provided with holes 3B1 for use in attaching the frame 3 to other members and an inner brim member 3B2 with an arc-like end connected to the longitudinal frame members 3A.

Moreover, each transversal frame member 3B is provided with a "π"-shaped edge cover rib 3GR that protrudes at both ends as surrounding the holes 3B1, as shown in FIG. 1. Two edge cover ribs 3GR on both ends of the frame 3 protect the thin edge member 2 from being torn out from the frame 3 or damaged due to external force to the seat members 2E protruding from the edge member 2 during the production or shipment of the SPU 50.

Fixed to each longitudinal frame member 3A is a rib 3AR that protrudes in the opposite direction of the protruding edge cover rib 3GR, with mail screws 3AR1 on both ends of the rib 3AR in the longitudinal direction for use in fixing the yoke 6.

The edge member 2 is attached to the frame 3, as described below. In FIG. 7, the edge member 2 is placed on the frame 3 from the front side so that the end portion of the edge member 2 meets a step section 3A1 of the frame 3.

In the longitudinal direction, an adhesive is applied between the inner wall of the flange section 2D of the edge member 2 and a side wall 3A1*a* of each longitudinal frame member 3A. In the transversal direction, an adhesive is applied between the lower surface of each of the seat members 2E (FIG. 1) provided at both ends of the edge member 2 in the longitudinal direction and the upper surface of each of the brim members 3B2 (FIG. 13) provided at both ends of the frame 3 in the longitudinal direction.

The frame 3 and edge member 2 are fixed to each other by application of the adhesive as described above so that the diaphragm 1 can be supported by the frame 3 via the edge member 2 but can vibrate freely in the frame 3.

(4) Drive Mechanism 40

As shown in FIG. 7, the drive mechanism 40 includes: the voice-coil bobbin 4 having the voice coil 5 wound therearound; the yoke 6 attached to the frame 3; the main magnet 7M attached to the yoke 6; the pole piece 8 attached to the magnet 7M, and the sub-magnet 7S attached to the pole piece 8.

The voice-coil bobbin 4 is formed as shown in FIG. 14. Two half-bobbin members 4*a* having a bottom wall 4*a*1 are fixed to each other to form the bobbin 4 having the same shape as the outer periphery of the diaphragm 1, or an oval shape with a length Lbc. Provided at the center of the bobbin 4 in the longitudinal direction is a wall 4*b* formed by attaching the bottom walls 4*a*1 to each other. The bobbin 4 has the voice coil 5 wound therearound, the two ends of the coil 5 being connected to a pair of lead wires 25. The bobbin 4 is fixed to the lower portions of the side sections 1*s* of the diaphragm 1 by an adhesive so that it is put in the step portions 1*s*1 (FIG. 7), as discussed above.

Figure 9:
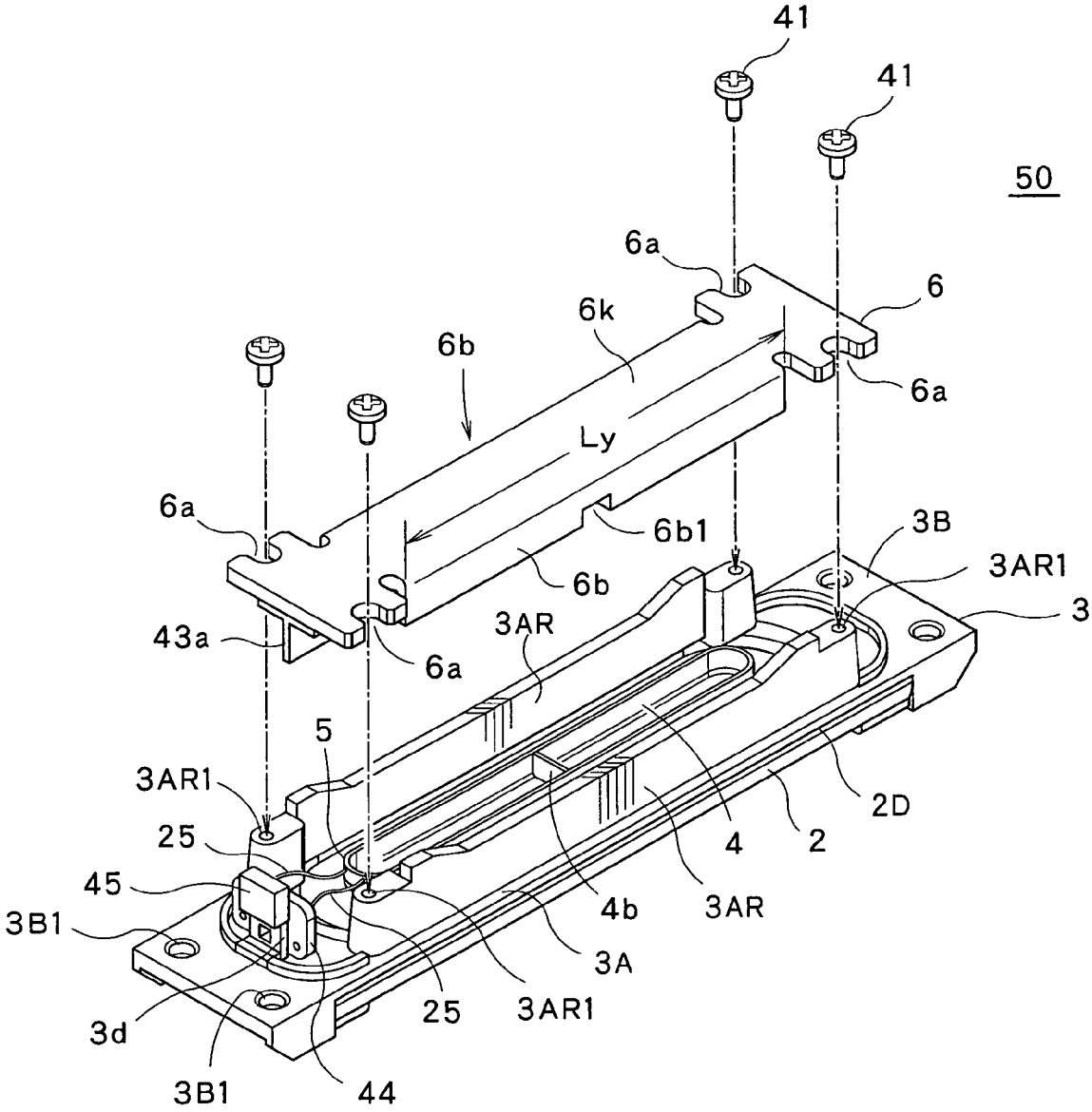
FIG. 9 shows an exploded view illustrating the embodiment of the electroacoustic transducer according to the present invention.

Shown in FIG. 9 is an exploded view of the SPU 50 in the rear side. In FIG. 9, the yoke 6 includes: a base member 6*k* with "U"-shape cutaways 6*a* at four corners, which are engaged with screws 41 to fix the yoke 6 to the frame 3; and folded side wall sections 6*b*. The yoke 6 has a "U"-shape cross section in the transversal direction, as having the folded side wall sections 6*b*.

The side wall sections 6*b* have a length Ly almost equal to the length Lbc of the voice-coil bobbin 4 (FIG. 14). Provided in each wall side section 6*b* at the center in the longitudinal direction is a rectangular cutaway 6*b*1. A tool (not shown) is engaged with the cutaway 6*b*1 in positioning of the yoke 6 and the main magnet 6M in the longitudinal direction when the magnet 6M is attached to the yoke 6.

Figure 15:
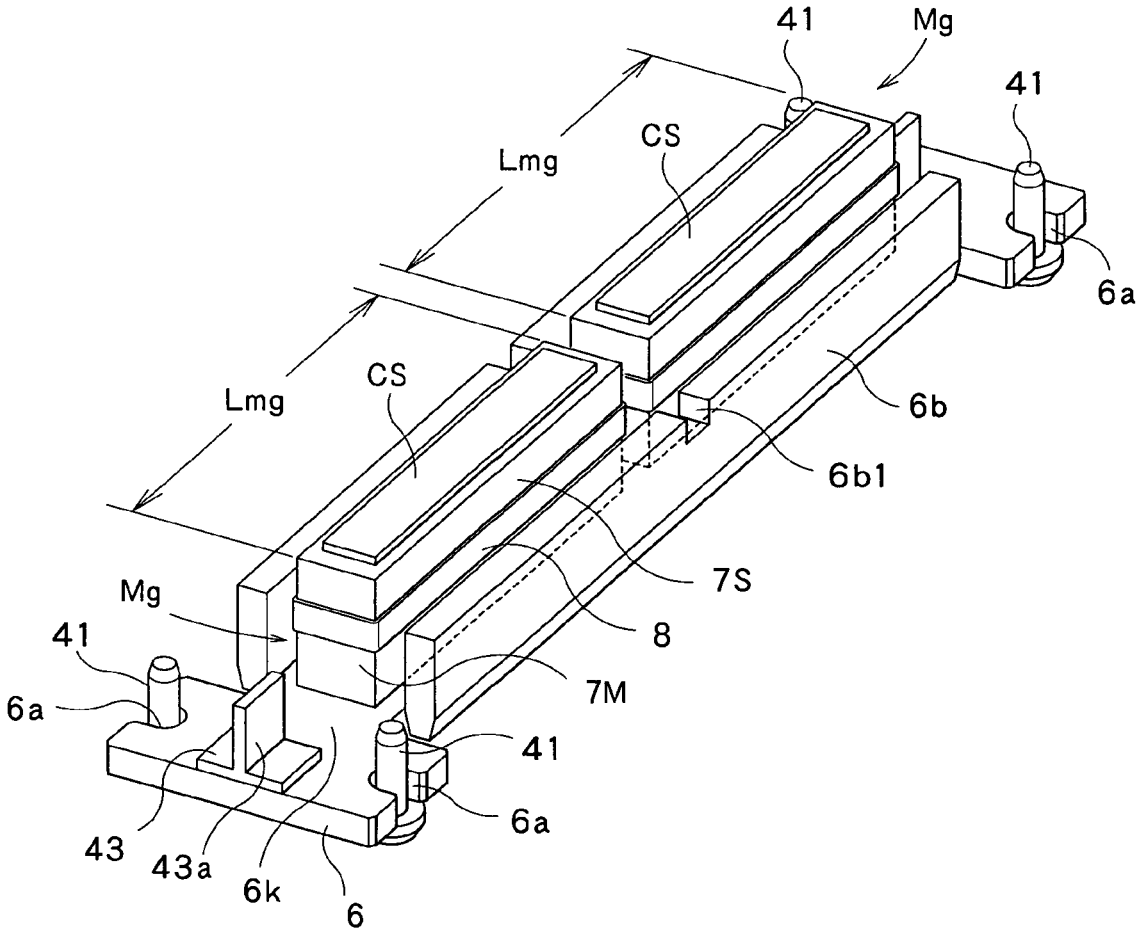
FIG. 15 shows a perspective view illustrating a drive mechanism in the embodiment of the electroacoustic transducer according to the present invention.

The yoke 6 is provided with an insulating separator 43 at one end in the front side, as shown in FIG. 15, or in the lower side in FIG. 9, although not shown. As shown in FIG. 15, the separator 43 is formed in a "T" shape in the cross section, having an insulating wall 43*a* that protrudes in the front side (in the upper side in FIG. 15) from the yoke 6.

As shown in FIG. 9, the insulating wall 43*a* is inserted between the lead wires 25 of the voice coil 5 when the yoke 6 is attached to the frame 3, to protect the wires 25 from touching each other. With no such an insulating wall, the wires 25 could suffer a larger swing to touch each other and hence suffer a short therebetween when the voice coil 5 vibrates violently with the diaphragm 1 due to a larger input applied to the SPU 50.

Each lead wire 25 is connected to a land on a relay board 44 attached to a rib 3*d* of the frame 3 by crimping. Provided on the relay board 44 is a connector 45 electrically connected to the land, an external electric power being supplied to the voice coil 5 via the connector 45 in driving the SPU 50.

FIG. 15 shows a perspective view illustrating the yoke 6 separated from the SPU 50. Fixed on the base member 6*k* in the front side (the upper sided in FIG. 15) by an adhesive are a pair of magnet units MG in the longitudinal direction. Each magnet unit MG consist of the main magnet 7M, the pole piece 8, and the sub-magnet 7S with the cushion sheet CS applied thereon, piled in order.

Each sub-magnet 7S has a length Lmg in the longitudinal direction, almost equal to a length 1A1 (FIG. 5) from the convex sections 11*a* (11*f*) to 11*e* (11*j*), or between the outer surfaces of the convex sections 11*a* (11*f*) and 11*e* (11*j*) opposite to each other, The pole piece 8 and the voice coil 5 are arranged such that, as shown in FIG. 7, their locations are almost equal to each other in the vibration direction V. The thicknesses of the pole piece 8 and the wound coil 5 are also made almost equal to each other.

The voice-coil bobbin 4 is joined at the outer periphery to the frame 3 via a suspension 42 having a wavy shape in the cross section, as shown in FIG. 7. The suspension 42 is made of thermal-resistant aramid fiber, for example, CONEX (a registered trademark), a known material for suspensions for use in speaker units. The suspension 42 made of this material moderately damps vibration of the voice-coil bobbin 4 to offer excellent reproduction characteristics. Moreover, the suspension 42 can be made of a thermal-resistant porous material or non-porous material with vents, that exhibits excellent ventilation, thus not preventing air flow generated in the rear side during the vibration of the diaphragm 1.

The SPU 50 in this embodiment is produced with the dimensions, for example, as listed below:

Transversal width Wk of the base member 1*k* (FIG. 6): 9 mm

Longitudinal length Lk of the base member 1*k* (FIG. 5): 95 mm

Longitudinal length LA of the main vibrating section 1A (FIG. 5): 80 mm

Transversal width Wks of the slant members 1*ks* (FIG. 6): 4 mm

Longitudinal length Lf of the SPU 50 (FIG. 3): 150 mm

Transversal length Wf of the SPU 50 (FIG. 3): 30 mm

With the dimensions listed above, when the area of the base member 1*k* (which is almost equal to the total area of the known diaphragm in Document 1) is 1, the area of the diaphragm 1 in the top view (FIG. 5) is 1.5 (=1+0.5), 0.5 being the area of the slant members 1*ks*. Thus, the diaphragm 1 of the SPU 50 in this embodiment is 50% larger than the known diaphragm concerning the area in the top view.

Moreover, with the dimensions listed above, the diaphragm 1 of the SPU 50 in this embodiment can be driven with a stroke length of ±3.5 mm to ±4.0 mm compared to that of ±2.0 mm to ±2.5 mm for the known diaphragm, thus achieving larger vibration.

The diaphragm 1 vibrates in the vibration direction V (FIG. 7), with its main vibrating section 1A attached to the voice-coil bobbin 4. The vibration occurs when a drive current flows through the voice coil 5 wound around the bobbin 4 in a magnetic field generated by the main magnet 7M, the pole piece 8, and the sub-magnet 7S, and then an electromagnetic force is applied to the bobbin 4 in the drive (vibration) direction V.

During the vibration, the diaphragm 1 exhibits higher linearity with a longer distance between the outer border line 2C2 (FIG. 12) and the lower end of the flange section 2D in the rear side in FIG. 7, with a relatively small width of the edge member 2. The outer border line 2C2 is located between the roll section 2C and the flange section 2D, as shown in FIG. 12. Such a longer distance is achieved with the structure shown in FIG. 7 in that the lower end of the flange section 2D (via which the edge member 2 is supported by the frame 3) is fixed to the frame 3 so that it is located in the rear side in the vibration direction V in relation to the outer border line 2C2 of the roll section 2C that supports the diaphragm 1 in vibration.

Moreover, the diaphragm 1 exhibits higher linearity in vibration with the structure shown in FIG. 12 in that, in the shorter area SA, the roll section 2C is formed as having the cross section for which the protruding height h1 and the roll width W1 are gradually increased from the transition starting point M1 toward the transition finishing point M2 (the top T of the arc). This structure also greatly reduces stress level and prevents stress concentration.

The SPU 50 in this embodiment also suffers heat generated from the voice coil 5, like the known SPUs. Particularly, the SPU 50 that has to meet the demand for excellent input characteristics to larger inputs, requires an excellent heat-dissipation structure to larger heat generation from the voice coil 5 when a larger current is applier thereto for larger sound outputs.

The known SPUs exhibit a poor heat-dissipation performance at the rear side of the diaphragm for inactive air flow and suffers much stress at the rear side due to the structure in that the yoke and the frame are fixed to each other at their side faces with an adhesive. A larger current to the known SPUs with the poor heat-dissipation performance greatly raises the temperature at the voice coil, which could cause burning out of the coil wirings, gradual deterioration of the adhesive or other members, change in vibration characteristics, etc., which leads to a shorter life for the SPUs.

Figure 3A:
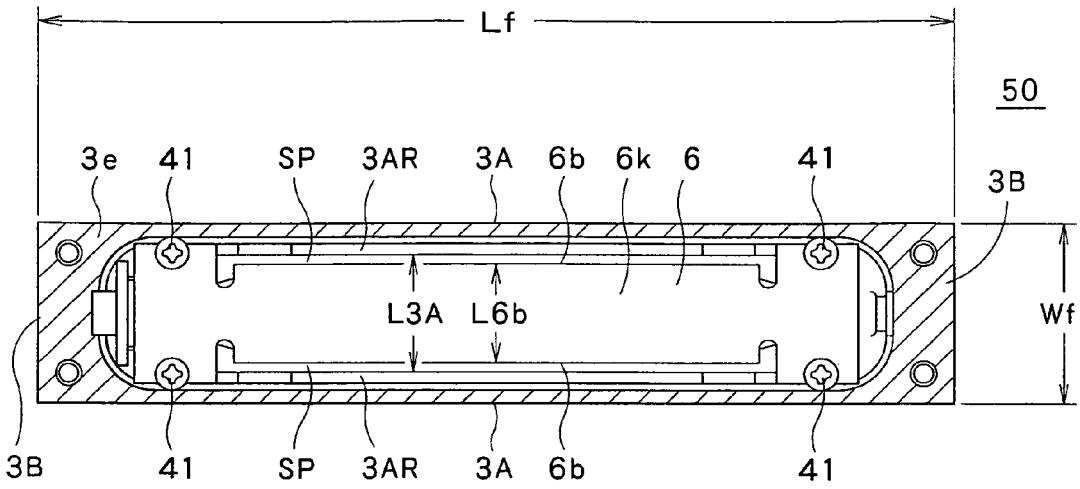
FIG. 3A shows a rear view illustrating the embodiment of the electroacoustic transducer according to the present invention.

On the contrary, as shown in FIGS. 3A and 7, the yoke 6 is fixed to the frame 3 with screws at the four corners, in the SPU 50 in this embodiment. Moreover, the SPU 50 is provided with gaps SP between the frame 3 and the yoke 6. In other words, the yoke 6 is not boned to the frame 3 at the side faces in the longitudinal direction. The gaps SP are provided by the arrangements such that a distance L6*b* between the outer surfaces of the side sections 6*b* is shorter than a distance L3A between the inner surfaces of the longitudinal frame members 3A.

With this structure, heat generated from the voice coil 5 is dissipated to the outside through the gaps SP at the rear side of the SPU 50. This excellent heat-dissipation performance does not allow big rise in temperature at the voice coil 5, which thus not cause burning out of the coil wirings, gradual deterioration of the adhesive or other members, change in vibration characteristics, etc., which gives a longer life to the SPU 50.

In this structure, the longitudinal frame members 3A of the frame 3 are formed into an extremely slender shape, with the minimized transversal length Wf (FIG. 3) and the arrangement in that the frame 6 and the yoke 6 are not fixed to each other at their side faces.

The frame 3 having these slender longitudinal frame members 3A is provided with the ribs 3AR having a particular thickness and height to give the frame 3 a high rigidity so that the members 3A do not vibrate when the diaphragm 1 vibrates.

The gaps SP provided between the frame 3 and the yoke 6, shown in FIGS. 3A and 7, greatly reduces the stress applied to the diaphragm 1 at the rear side during vibration. The reduction of stress leads to great reduction of aerodynamic noises which are often generated to the known SPUs, especially, in the lower frequency range, due to much stress to the rear side of the SPUs.

The SPU 50 in this embodiment is equipped with the seat members 2E, as shown in FIG. 1 and already described. The seat members 2E are provided so that several SPUs 50 can be piled in the drive direction V with no damages.

Figure 16:
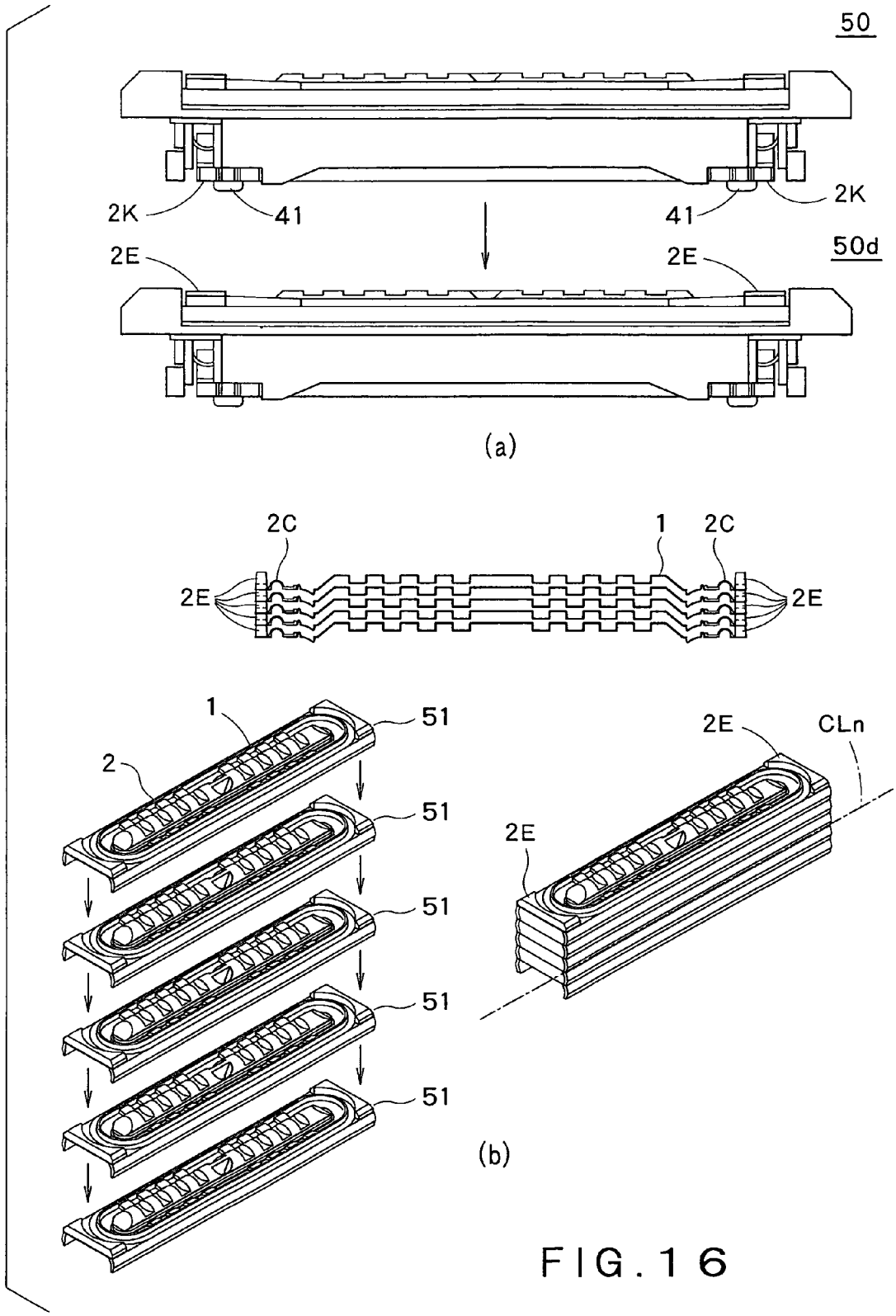
FIG. 16 shows illustrations explaining advantages of the electroacoustic transducer with a diaphragm assembly in the embodiment according to the present invention.

In detail, when several SPUs 50 are piled, the ends of the base member 6*k* or the screws 41 (FIG. 9) in the longitudinal direction of an upper SPU 50 meet the seat members 2E of a lower SPU 50, as shown in (a) of FIG. 16. The upper SPU 50 can be placed on the lower SPU 50 with no damages because the weight of the upper SPU 50 is applied to the seat members 2E of the lower SPU 50, not to the diaphragm 1 of the lower SPU 50.

The known SPUs requires spacers therebetween when piled so that the diaphragms can not be damaged, that leads to increase in cost and man-hours.

In contrast, the embodiment of the present invention dose not increase cost and man-hours in production and shipment of the SPU 50 because of the seat members 2E.

In detail, as shown in (b) of FIG. 16, the seat members 2E protrude in the front side (the upper drawing in (b) of FIG. 16 being a cross sectional view taken on line CLn in the middle drawing in (b) of FIG. 16). Therefore, when several diaphragm assemblies 51 each having the diaphragm 1 and the edge member 2 are piled, the seat members 2E of a lower diaphragm assembly 51 meet the lower surface of the edge member 2 (the lower surfaces of the seat members 2E) of an upper diaphragm assembly 51. In other words, several diaphragm assemblies 51 can be piled tight, without physical contact between the edge member 2 (except for the seat members 2E) and the diaphragm 1 of each diaphragm assembly 51, and other diaphragm assemblies 51 or other members. This achieves space saving and easier handling of the diaphragm assemblies 51 with decreased deterioration due to damages to the diaphragms 1, edge members 2, etc.

Figure 2:
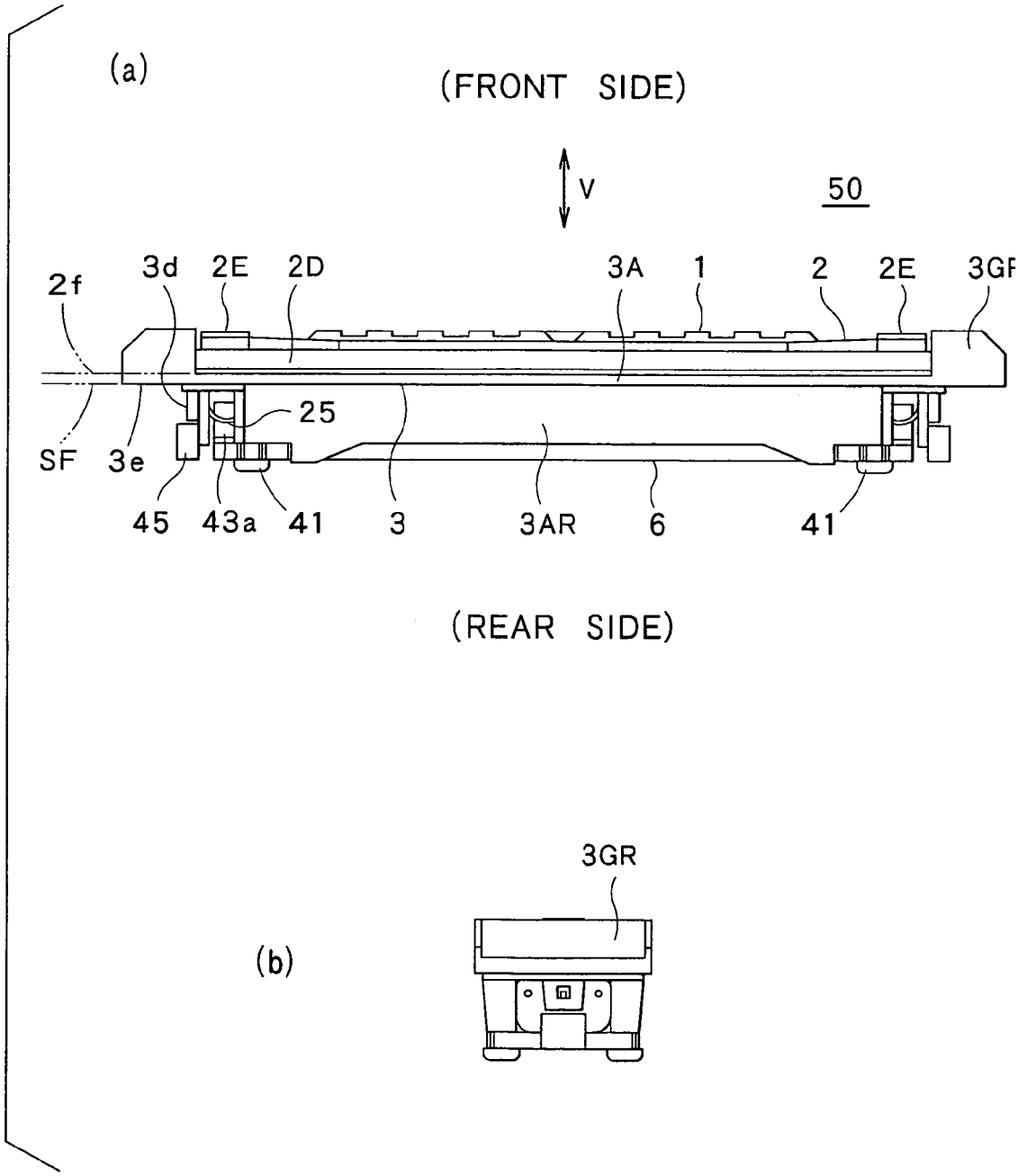
FIG. 2 shows a side view (a) and an end view (b) illustrating the embodiment of the electroacoustic transducer according to the present invention.
Figure 3B:
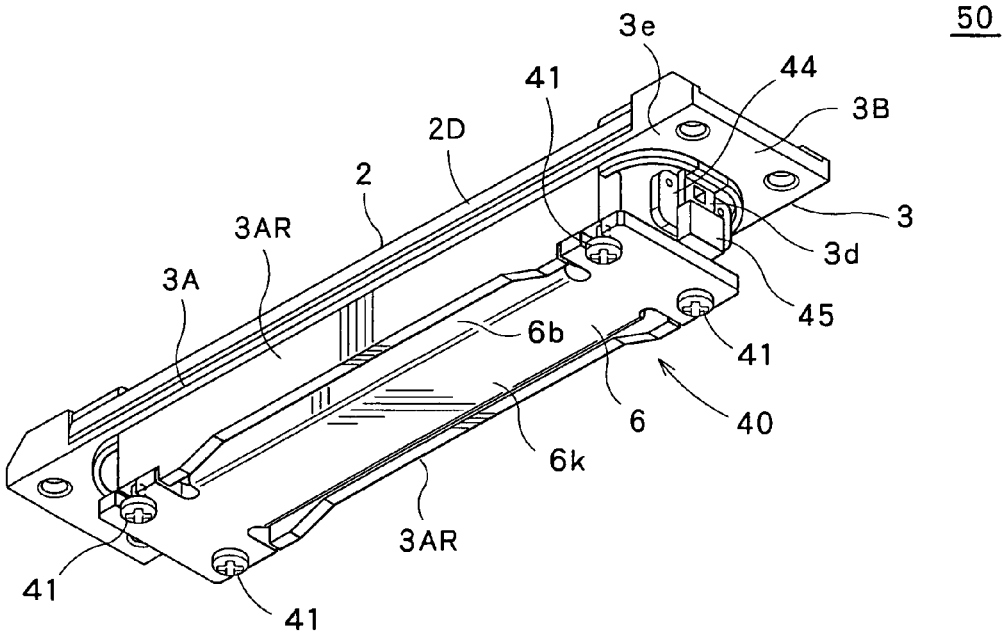
FIG. 3B shows a rear perspective view illustrating the embodiment of the electroacoustic transducer according to the present invention.

As shown in FIGS. 2 and 3, the SPU 50 is provided with an installation reference surface SF (a rear surface 3*e* of each transversal frame member 3B) for use in installation of the SPU 50 in, for example, a cabinet.

The installation reference surface SF is formed as a flat surface that sounds the rear surface 3*e* and located in the rear side in relation to an end of each flange section 2D of the edge member 2 in the drive direction V. The end is the lowermost portion of each flange section 2D in FIG. 12 and the position of the end is pointed by a chain double-dashed line 2*f* in FIG. 2. When the SPU 50 is installed in the cabinet, the hatched area of the rear surface 3*e*, shown in (a) of FIG. 3, is tightly attached to an installation surface of the cabinet, which offers excellent audio characteristics with no mixture of sounds released in the rear and front sides from the diaphragm 1.

Suppose that, in FIG. 2, the installation reference surface SF is located in the front side in relation to each flange section 2D (the position of the section 2D being pointed by the chain double-dashed line 2*f*) in the drive direction V, or the end of each flange section 2D is located in the rear side in relation to the surface SF in the direction V.

In this structure, the cabinet requires mounting holes to give a gap between the cabinet and the flange section 2D so that the cabinet does not touch the flange section 2D when the SPU 50 is installed. And, the gap has to be filled with a filler after the installation.

However, the embodiment with the flat installation reference surface SF located in the rear side in relation to each flange section 2D (the chain double-dashed line 2*f*) in the drive direction V, does not require such mounting holes and a filler, thus achieves reduction of man-hours in installation and offers excellent sealing property.

Disclosed next are several modifications to the diaphragm 1 of the SPU 50 according to the present invention. In the modifications, the same reference signs are given to the elements or members that correspond to those in the embodiment.

As shown in FIG. 6, the slant member 1*ks* of the diaphragm 1 have a curved cross section that protrudes in the front side. Not only that, the slant member 1*ks* may have a curved cross section that protrudes in the rear side, as shown in (b) and (c) of FIG. 17.

Figure 17:
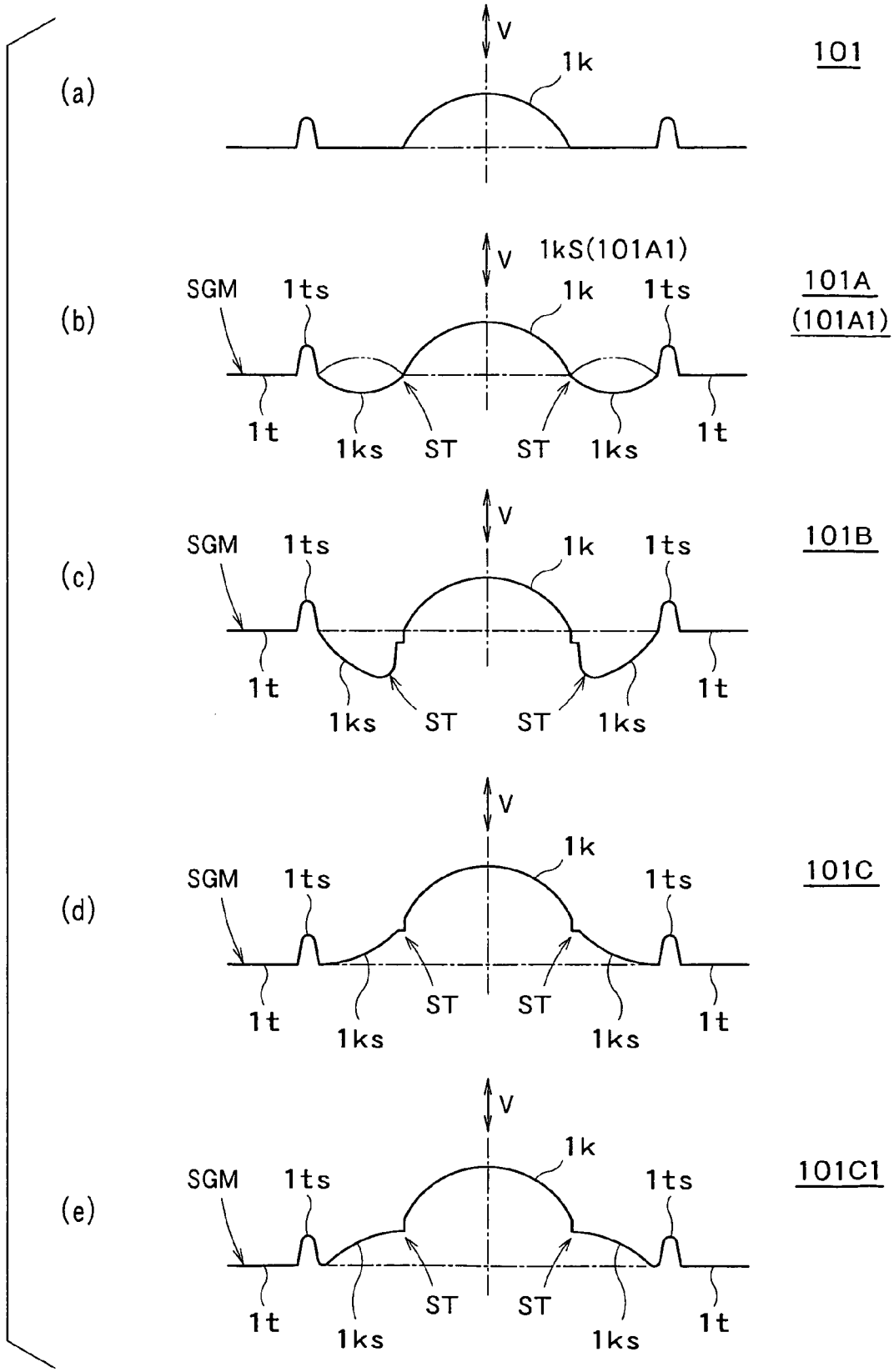
FIG. 17 shows illustrations explaining several variations to the diaphragm in the embodiment of the electroacoustic transducer according to the present invention.

A diaphragm 101B having the slant member 1*ks* shown in (c) of FIG. 17 is formed as having bottom portions ST (the inner ends of the slant member 1*ks*) located in the rear side in relation to an interface SGM of each brim section 1*t* with an edge member 2 (not shown) in the drive direction V, in the same manner as the embodiment shown in FIG. 6.

The slant member 1*ks* in the embodiment and modifications are formed as having a curved surface that offers higher rigidity which leads to more constant frequency characteristics and a wider range of linearity in response (vibration) to larger inputs, with improved reproduction characteristics in a lower frequency range, than the counterpart of a diaphragm 101, shown in (a) of FIG. 17, with a flat surface.

Shown in (b) of FIG. 17 is another modification that is a diaphragm 101A1 having a slant member 1*ks* with a curved surface that protrudes in the front side, as depicted by a chain double dash line.

Shown in (d) and (e) of FIG. 17 are other modifications in which each bottom portion ST is located in the front side in relation to an interface SGM: a diaphragm 101C in (d) having a slant member 1*ks* with a curved surface that protrudes in the rear side; and a diaphragm 101C1 in (e) having a slant member 1*ks* with a curved surface that protrudes in the front side.

The diaphragms 101C and 101C1 shown in (d) and (e), respectively, of FIG. 17 have a base member 1*k* located in the front side compared to the counterpart of the diaphragms 101A (101A1) and 101B shown in (b) and (c), respectively, of the same figure. An SPU having such a diaphragm exhibits excellent direction characteristics but requires a larger body in the drive direction V.

A more feasible direction property can be gained with the base member 1*k* having a curved surface KMB (FIG. 6) located in the front side, at least, compared to the interface SGM.

A further feasible direction property can be gained with the step portions 1*s*1 of side sections 1*s* located in the same position as the interface SGM, as shown in FIG. 6, or in the front side compared to the interface SGM.

The shape of the diaphragm can be selected among the diaphragm 1 (the embodiment) and the diaphragms 101A, 101A1, 101B, 101C, and 101C1 (the modifications), depending on the requirements or the condition of an environment where an SPU is installed. The combination of shapes in the embodiment and the modifications is also possible.

The slant member 1*ks* having the convex and concave sections is feasible than a flat one. These convex and concave sections are preferably provided so as to correspond to the convex and concave sections 11*a* to 11*j* and 12*a* to 12*h* formed on the base member 1*k*, as shown in FIGS. 4 and 5.

The convex and concave correspondence between the slant member 1*ks* and the base member 1*k* may be in the opposite phase in which the convex sections 13*a*1 to 13*h*1 and 13*a*2 to 13*h*2 of the slant member 1*ks* are provided in the locations that match the locations of the concave sections 12*a* to 12*d* and 12*e* to 12*h* of the base member 1*k*, as shown in FIG. 5. Or, the convex and concave correspondence may be in phase in which the convex sections 13*a*1 to 13*h*1 and 13*a*2 to 13*h*2 are provided in the locations that match the locations of the convex sections 11*a* to 11*e* and 11*f* to 11*j* of the base member 1*k*, although not shown.

It is preferable for the slant member 1*ks* to have the convex sections protruding toward the front side, like the convex sections 13*a*1 to 13*h*1 and 13*a*2 to 13*h*2 shown in FIG. 1. Because, convex sections protruding toward the rear side causes a shorter stroke for the diaphragm 1 by the length of protruding toward the rear side, which restricts the input characteristics to larger inputs.

The SPU 50 in this embodiment is highly efficient, stable in frequency reproduction, and also stable in driving with a longer stroke to larger inputs, as well as excellent in heat-dissipation performance with a longer life and a higher reliability, and decreased aerodynamic noises in low frequency ranges.

The SPU 50 in this embodiment has several other advantages: higher efficiency in assembly and transfer operations because several SPUs 50 can be easily piled to each other; higher sealing performance in installation to a cabinet; and no short-cut between the lead wirings to driving at lager strokes.

Discussed next is comparison of the direction and reproduction frequency characteristics between the SPU 50 in this embodiment and a sample SPU for comparison.

Figure 19:
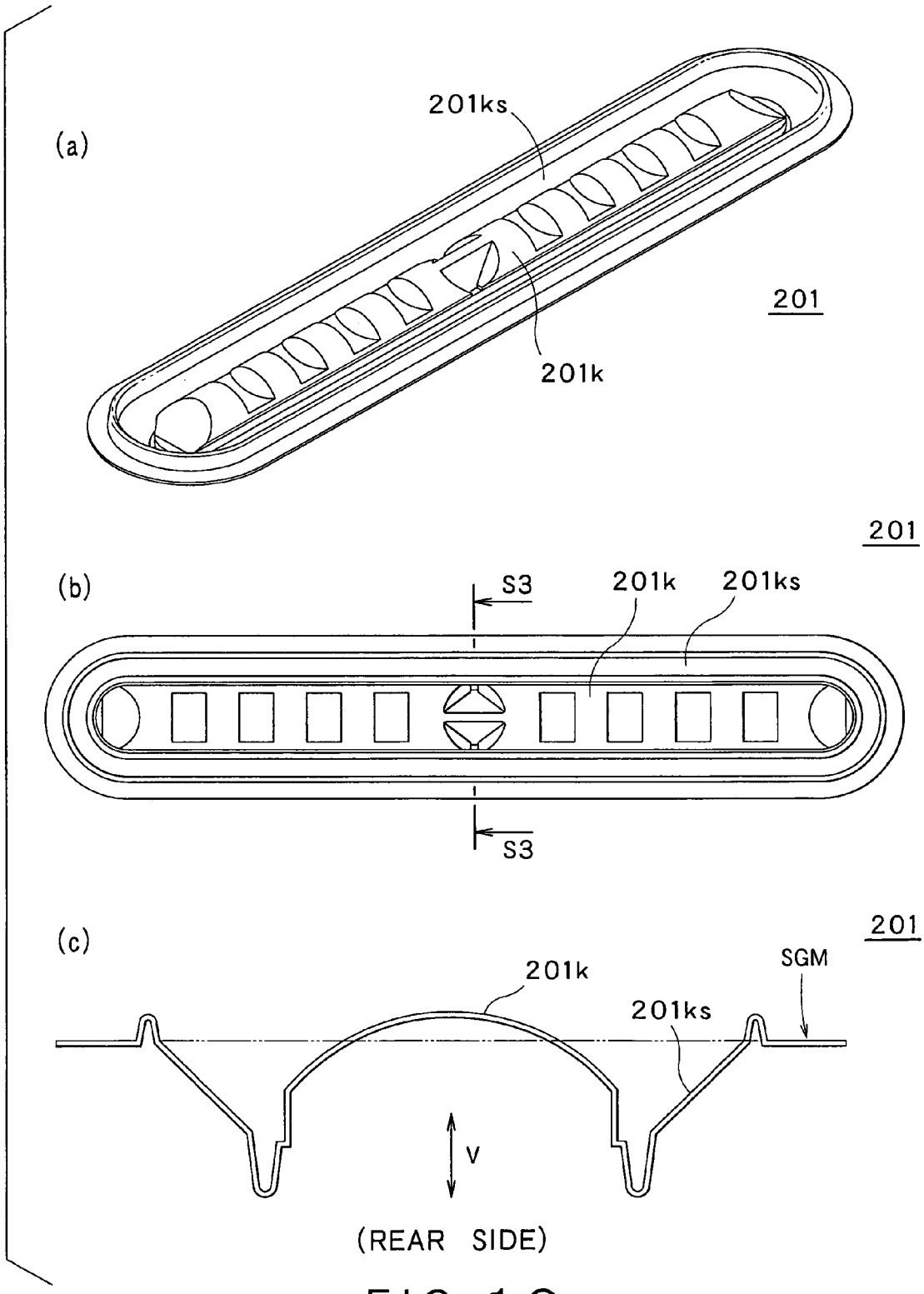
FIG. 19 shows a diaphragm for comparison, with a perspective view (a), a front view (b), and a sectional view (c) taken on line S3-S3 in the top view (b).

The sample SPU is equipped with a diaphragm 201 instead of the diaphragm 1, shown in FIG. 19. As shown in (c) of FIG. 19, the diaphragm 201 has a base member 201*k* provided in the rear side compared to the counterpart 1*k* shown in FIG. 6, and a flat slant member 201*ks* with no concave and convex sections, like the convex sections 13*a*1 to 13*h*1 and 13*a*2 to 13*h*2 shown in FIG. 1.

Figure 18A:
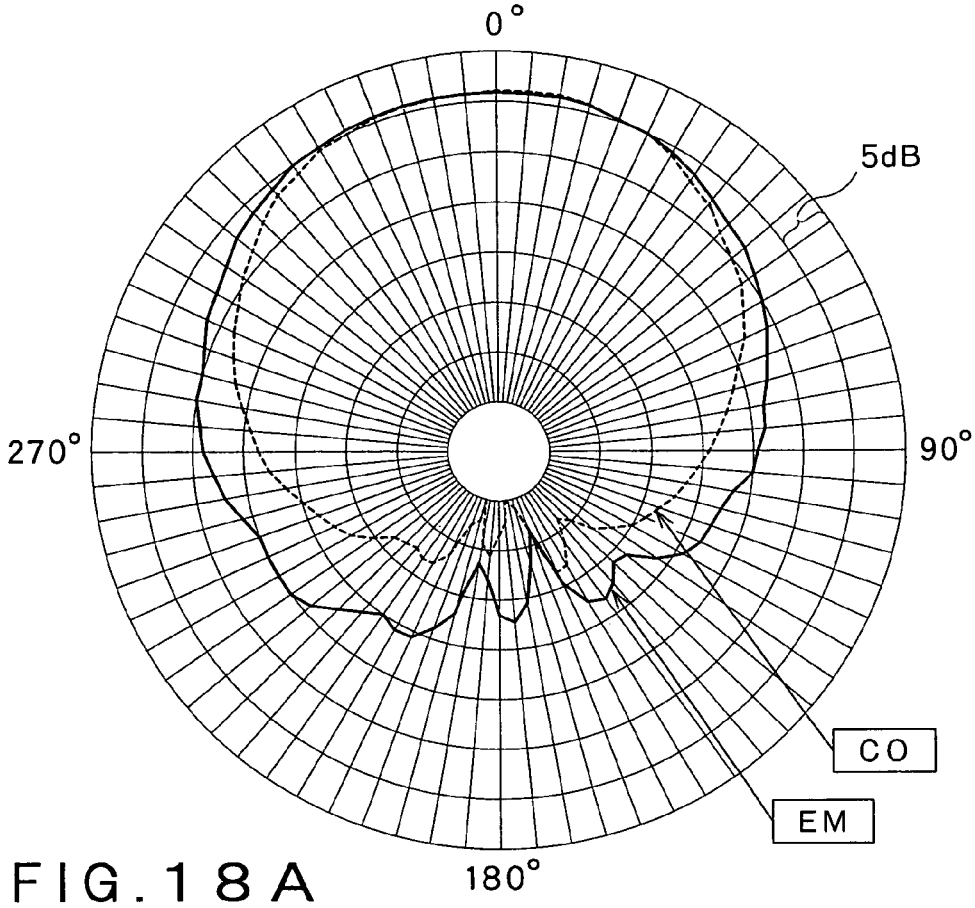
FIG. 18A shows a graph explaining advantages of the embodiment of the electroacoustic transducer according to the present invention.

Discussed first is the direction characteristics with reference to FIG. 18A in which a solid-line graph pointed by a reference sign EM is the embodiment of the invention and a dashed-line graph pointed by a reference sign CO is the sample SPU for comparison, with a decibel scale having a 5-dB interval in the radius direction.

The chart in FIG. 18A shows that the SPU 50 in the embodiment is superior to the sample SPU on the direction characteristics, the difference being more visible as apart from the front side (0°) and about 5 dB at 90° and 270°.

The excellent direction characteristics is given by the arrangements, shown in FIG. 6, in which the step portion 1*s*1 of each side section 1*s* is located in the same position as the interface SGM whereas the curved surface KMB of the base member 1*k* is located in the front side compared to the interface SGM.

Discussed next is the reproduction frequency characteristics with reference to FIG. 18B in which a solid-line graph pointed by a reference sign EM is the embodiment of the invention and a dashed-line graph pointed by a reference sign CO is the sample SPU for comparison.

Figure 18B:
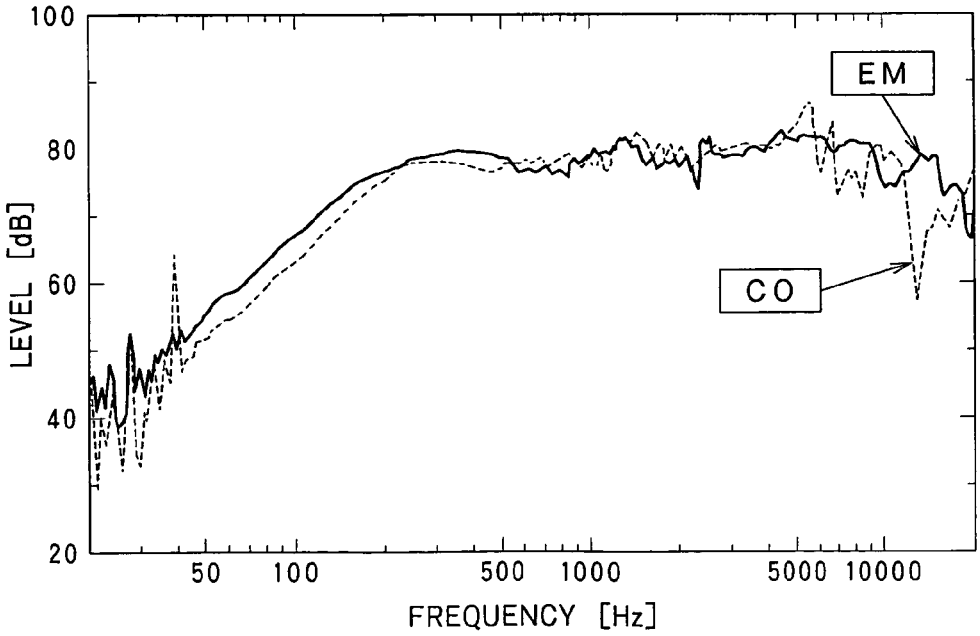
FIG. 18B shows a graph explaining advantages of the embodiment of the electroacoustic transducer according to the present invention.

The chart in FIG. 18B shows that the SPU 50 in the embodiment is superior to the sample SPU on the reproduction frequency characteristics, with no visible peaks and dips, excellent over the wide range of frequency.

Particularly, the SPU 50 exhibits higher levels in reproduction than the sample SPU in the range of 500 Hz or lower, excellent in reproduction of lower sounds. This is due to difference in rigidity between the curved slant member 1*ks* with the convex sections 13*a*1 to 13*h*1 and 13*a*2 to 13*h*2 shown in FIG. 1 and the flat slant member 201*ks* with no convex sections shown in (c) of FIG. 1. The curved slant member 1*ks* with the convex sections exhibits higher rigidity than the flat slant member 201*ks* with no convex sections.

It is further understood by those skilled in the art that the foregoing description is made for the embodiment and the several modifications and that various changes and modifications may further be made to the structure and assembly steps in the invention without departing from the sprit and scope thereof.

For example, it is most feasible for the slant member 1*ks* to have the concave and convex sections so as to respond to those of the base member 1*k* in position and width in the longitudinal direction, as shown in FIG. 5.

Not only that, it is also preferable to change the position or width of the concave and convex sections of the slant member 1*ks* with respect to those of the base member 1*k* in the longitudinal direction. Or, the slant member 1*ks* may have concave and convex sections on both ends thereof in the longitudinal direction. Moreover, the base member 1*k* may be formed into a semi-cylinder shape with no concave and convex sections.

One requirement is that the slant member 1*ks* has a curved shape with concave and convex sections, for higher rigidity to the vibration of the diaphragm 1.

What is claimed is:

1. A diaphragm longer in a longitudinal direction and shorter in a transversal direction in relation to the longitudinal direction, comprising:

a base member having a pair of extending members provided in parallel in the longitudinal direction as facing each other, and a curved section that protrudes toward a first side of the diaphragm in a vibration direction of the diaphragm from a first plane that includes the extending members, the vibration direction being perpendicular to the longitudinal and transversal directions; and a slant member having a slant surface in relation to the first plane and connected to the base member in a manner that the slant member surrounds the base member in a second plane parallel to the first plane, the slant member having a curved surface in a cross section thereof in relation to a cross section of the base member in the transversal direction, wherein the slant member has a plurality of concave and convex sections only in a zone of the slant surface, the concave and convex sections having the same curvature and being separated from one another and aligned in the longitudinal direction, and the concave and convex sections being aligned in parallel to a center line of the base member in the transversal direction, the zone corresponding to the extending members of the base member.

2. The diaphragm according to claim 1, wherein the curved section of the base member has a plurality of concave sections formed as separated from one another and aligned in the longitudinal direction, the convex section of the slant member being provided at locations corresponding to locations of the concave sections of the curved section in the longitudinal direction.

3. The diaphragm according to claim 1, wherein the curved surface of the slant member has a center of curvature that is located in a second side of the diaphragm, the second side being opposite of the first side in the vibrating direction.

4. The diaphragm according to claim 1 further comprising:

a voice-coil bobbin having a shape corresponding to the shape of the diaphragm and fixed in a first side of the diaphragm in the vibration direction, a voice-coil wound around the voice-coil bobbin, a pair of lead wires being connected to the voice coil and pulled out from an end of the voice-coil bobbin;

at least one magnet provided inside the voice-coil bobbin; and a yoke for supporting the magnet, the yoke having an insulating wall that protrudes toward a second side of the diaphragm, the second side being opposite of the first side in the vibration direction, the insulating wall being located between the lead wires outside the voice-coil bobbin.

5. A diaphragm assembly comprising:

a diaphragm having a first length in a longitudinal direction and a second length in a transversal direction in relation to the longitudinal direction, the first length being longer than the second length, the diaphragm including:

a base member having a pair of extending members provided in parallel in the longitudinal direction as facing each other, and a curved section that protrudes toward a first side of the diaphragm in a vibration direction of the diaphragm from a first plane that includes the extending members, the vibration direction being perpendicular to the longitudinal and transversal directions, and a slant member having a slant surface in relation to the first plane and connected to the base member in a manner that the slant member surrounds the base member in a second plane parallel to the first plane, the slant member having a curved surface in a cross section thereof in relation to a cross section of the base member in the transversal direction, the diaphragm assembly further comprising:

an edge member having a third length in the longitudinal direction and a fourth length in the transversal direction, the third length being longer than the first and fourth lengths, the fourth length being longer than the second length, the diaphragm being supported by the edge member in a manner that the edge member surrounds the diaphragm in a third plane parallel to the first plane, the edge member having a roll section protruding in the first side and the edge member having a flange that has an inner wall that surrounds the diaphragm in the third plane, the inner wall having an upper end connected to a leg of the roll section and having a lower end, the inner wall extending straight from the upper end to the lower end in a second side of the diaphragm, the second side being opposite of the first side in the vibrating direction.

6. The diaphragm assembly according to claim 5, wherein the edge member has seat members at both ends thereof in the longitudinal direction, the seat members protruding toward the first side of the diaphragm, when a plurality of units of the diaphragm assembly are piled, only the seat members of a first diaphragm assembly touches a second diaphragm assembly placed on the first diaphragm in the first side among the piled units.

7. The diaphragm assembly according to claim 5 further comprising:

a voice-coil bobbin having a shape corresponding to the shape of the diaphragm and fixed in a first side of the diaphragm in the vibration direction, a voice coil wound around the voice-coil bobbin, a pair of lead wires being connected to the voice coil and pulled out from an end of the voice-coil bobbin;

at least one magnet provided inside the voice-coil bobbin; and a yoke for supporting the magnet, the yoke having an insulating wall that protrudes toward a second side of the diaphragm, the second side being opposite of the first side in the vibration direction, the insulating wall being located between the lead wires outside the voice-coil bobbin.

8. An electroacoustic transducer comprising:

a diaphragm assembly including:

a diaphragm having a first length in a longitudinal direction and a second length in a transversal direction in relation to the longitudinal direction, the first length being longer than the second length, the diaphragm including a base member having a pair of extending members provided in parallel in the longitudinal direction as facing each other, and a curved section that protrudes toward a first side of the diaphragm in a vibrating direction of the diaphragm from a first plane that includes the extending members, the vibrating direction being perpendicular to the longitudinal and transversal directions, and the diaphragm including a slant member having a slant surface in relation to the first plane and connected to the base member in a manner that the slant member surrounds the base member in a second plane parallel to the first plane, the slant member having a curved surface in a cross section thereof in relation to a cross section of the base member in the transversal direction; and an edge member having a third length in the longitudinal direction and a fourth length in the transversal direction, the third length being longer than the first and fourth lengths, the fourth length being longer than the second length, the diaphragm being supported by the edge member in a manner that the edge member surrounds the diaphragm in a third plane parallel to the first plane, the edge member having a roll section protruding in the first side and the edge member having a flange that has an inner wall that surrounds the diaphragm in the third plane, the inner wall having an upper end connected to a leg of the roll section and having a lower end, the inner wall extending straight from the upper end to the lower end in a second side of the diaphragm, the second side being opposite of the first side in the vibration direction, the electroacoustic transducer further comprising:

a frame having a pair of first frame members in the longitudinal direction and a pair of second frame members in the transversal direction, the first frame members being longer than the second frame members, the first frame members being fixed to the flange in the second side of the diaphragm so that a part of each first frame member protrudes toward the flange to be fixed to the inner wall of the flange in the vibrating direction, the frame being fixed to the edge member in a manner that the diaphragm assembly is surrounded by the frame in a fourth plane parallel to the first plane, and can vibrate in the vibrating direction in the frame.

9. The electroacoustic transducer according to claim 8, wherein the frame has a flat surface section located further in the second side of the diaphragm compared to the lower end of the inner wall of the flange extending in the second side.

10. The electroacoustic transducer according to claim 8 further comprising:

a voice-coil bobbin having a shape corresponding to the shape of the diaphragm and fixed in a first side of the diaphragm in the vibration direction, a voice coil wound around the voice-coil bobbin, a pair of lead wires being connected to the voice coil and pulled out from an end of the voice-coil bobbin;

at least one magnet provided inside the voice-coil bobbin; and a yoke for supporting the magnet, the yoke having an insulating wall that protrudes toward a second side of the diaphragm, the second side being opposite of the first side in the vibration direction, the insulating wall being located between the lead wires outside the voice-coil bobbin.

* * * * *